US011913651B2

(12) United States Patent
Yu et al.

(10) Patent No.: US 11,913,651 B2
(45) Date of Patent: Feb. 27, 2024

(54) HEAT EXCHANGER AND WINDOW AIR CONDITIONER HAVING SAME

(71) Applicants: GD MIDEA AIR-CONDITIONING EQUIPMENT CO., LTD., Foshan (CN); MIDEA GROUP CO., LTD., Foshan (CN)

(72) Inventors: Hui Yu, Foshan (CN); Zhigang Xing, Foshan (CN); Zhisheng Lei, Foshan (CN); Kangwen Zhang, Foshan (CN); Yu Liu, Foshan (CN); Wenjun Shen, Foshan (CN); Yuhang Tang, Foshan (CN); Yuanshun Huang, Foshan (CN)

(73) Assignees: GD MIDEA AIR-CONDITIONING EQUIPMENT CO., LTD., Foshan (CN); MIDEA GROUP CO., LTD., Foshan (CN)

( * ) Notice: Subject to any disclaimer, the term of this patent is extended or adjusted under 35 U.S.C. 154(b) by 224 days.

(21) Appl. No.: 17/427,400

(22) PCT Filed: Jan. 19, 2020

(86) PCT No.: PCT/CN2020/073044
§ 371 (c)(1),
(2) Date: Jul. 30, 2021

(87) PCT Pub. No.: WO2020/156289
PCT Pub. Date: Aug. 6, 2020

(65) Prior Publication Data

US 2022/0099310 A1 Mar. 31, 2022

(30) Foreign Application Priority Data

Feb. 3, 2019 (CN) ..... 201920188060.9
Apr. 12, 2019 (CN) ..... 201920511241.0
Apr. 12, 2019 (CN) ..... 201920511244.4

(51) Int. Cl.
*F24F 1/028* (2019.01)
*F24F 1/029* (2019.01)
(Continued)

(52) U.S. Cl.
CPC ..... *F24F 1/028* (2019.02); *F24F 1/029* (2019.02); *F24F 1/035* (2019.02); *F24F 1/0325* (2019.02)

(58) Field of Classification Search
CPC ..... F24F 1/027; F24F 1/035; F24F 1/0325; F24F 1/029; F28F 1/32; F28D 2001/0266
See application file for complete search history.

(56) References Cited

U.S. PATENT DOCUMENTS 2,472,792 A * 6/1949 Cohler ..... F24F 1/027 62/448
8,584,998 B1 * 11/2013 Peterson ..... F24F 13/32 182/62

(Continued)

FOREIGN PATENT DOCUMENTS

CN 204649012 U 9/2015
CN 208025643 U 10/2018

(Continued)

OTHER PUBLICATIONS

JP2002022258A Translation (Year: 2002).*

(Continued)

*Primary Examiner* — Schyler S Sanks
(74) *Attorney, Agent, or Firm* — Anova Law Group, PLLC

(57) ABSTRACT

A heat exchanger includes a fin set formed by a plurality of fins stacked together and a refrigerant pipe set passing through the fin set. The fin set includes a connection member, and a first fin member and a second fin member connected to each other via the connection member. An (Continued)

included angle between the first fin member and the second fin member is larger than zero. The first fin member and the second fin member are arranged at two sides, respectively, of a notch of the fin set. The notch is located at an air input side and/or an air output side of the connection member.

18 Claims, 24 Drawing Sheets

(51) Int. Cl.
*F24F 1/0325* (2019.01)
*F24F 1/035* (2019.01)

(56) References Cited

U.S. PATENT DOCUMENTS

| | | | | |
|---|---|---|---|---|
| 2004/0168461 | A1* | 9/2004 | Park | F24F 1/027 62/262 |
| 2005/0056037 | A1* | 3/2005 | Park | F24F 13/20 62/262 |

FOREIGN PATENT DOCUMENTS

| | | | | | |
|---|---|---|---|---|---|
| CN | 108870565 | A | | 11/2018 | |
| CN | 209558559 | U | | 10/2019 | |
| CN | 209763329 | U | | 12/2019 | |
| JP | H04288483 | A | | 10/1992 | |
| JP | H05164347 | A | | 6/1993 | |
| JP | H09060906 | A | | 3/1997 | |
| JP | H09210587 | A | | 8/1997 | |
| JP | 2002022258 | A | * | 1/2002 | |
| JP | 2002022258 | A | | 1/2002 | |
| JP | 2003014388 | A | | 1/2003 | |
| KR | 20060005071 | A | * | 1/2006 | F24F 13/20 |

OTHER PUBLICATIONS

KR20060005071A Translation (Year: 2006).*
World Intellectual Property Organization (WIPO) International Search Report and Written Opinion for PCT/CN2020/073044 dated Apr. 16, 2020 23 pages (with translation).

* cited by examiner

F5

F6

HEAT EXCHANGER AND WINDOW AIR CONDITIONER HAVING SAME

CROSS-REFERENCE TO RELATED APPLICATIONS

This application is a National Stage Entry under 35 U.S.C. § 371 of International Application No. PCT/CN2020/073044, filed on Jan. 19, 2020, which is based on and claims priority to Chinese Patent Application No. 201920511244.4, filed on Apr. 12, 2019, Chinese Patent Application No. 201920188060.9, filed on Feb. 3, 2019, and Chinese Patent Application No. 201920511241.0, filed on Apr. 12, 2019. The entire contents of the above patent applications are incorporated herein by reference.

FIELD

The present application relates to a field of air conditioning technologies, and more particularly, to a heat exchanger and a window air conditioner having the same.

BACKGROUND

Some air conditioners in the related art adopt a multi-fold heat exchanger, which is formed by splicing a plurality of single heat exchangers, and a sponge, a snap ring or the like is arranged at a splicing portion to realize sealing. However, this multi-fold heat exchanger has a low production efficiency and a high cost. Moreover, this multi-fold heat exchanger has a large working noise and a low heat exchange efficiency.

SUMMARY

The present application aims to solve one of the technical problems in the related art to a certain extent.

To this end, an objective of the present application is to propose a heat exchanger.

Another objective of the present application is to propose a window air conditioner.

The heat exchanger according to embodiments of the present application includes a fin set and a refrigerant pipe set, the fin set is formed by stacking a plurality of fins, and the refrigerant pipe set passes through the fin set. The fin set has a first notch and a first connection member, the first notch is located at an air input side and/or an air output side of the first connection member, the fin set is bent into a first fin member and a second fin member on two sides of the first notch, and the first fin member and the second fin member are connected via the first connection member and have a non-zero included angle therebetween.

The heat exchanger according to the embodiments of the present application has a high production efficiency, a low production cost, a good sealing performance, a low working noise and a high heat exchange efficiency.

In some embodiments, the first notch includes two first sub notches, and the two first sub notches are arranged at the air input side and the air output side of the first connection member, respectively.

In some embodiments, after bending, a first gap is formed between the first fin member and the second fin member at the first notch.

In some embodiments, the first fin member extends vertically from top to bottom, the second fin member is connected below the first fin member via the first connection member, and extends from top to bottom obliquely relative to the first fin member in a direction of the air output side, and when an orthogonal projection to a plane of any one of the fins is made, an included angle a1 between the first fin member and the second fin member is 25°~45°, and a length H2 of the second fin member is 2~3 times of a length H1 of the first fin member.

In some embodiments, the fin set further has a second notch and a second connection member, the second notch is located at an air input side and/or an air output side of the second connection member, the fin set is bent into the second fin member and a third fin member on two sides of the second notch, the second fin member and the third fin member are connected via the second connection member and have a non-zero included angle therebetween, wherein the second fin member is located between the first notch and the second notch, and the first fin member and the third fin member are arranged at two sides of the second fin member.

In some embodiments, the second notch includes two second sub notches, and the two second sub notches are arranged at the air input side and the air output side of the second connection member, respectively.

In some embodiments, after bending, a second gap is formed between the second fin member and the third fin member at the second notch.

In some embodiments, the first fin member extends vertically from top to bottom, the second fin member is connected below the first fin member via the first connection member, and extends from top to bottom obliquely relative to the first fin member in a direction of the air output side, the third fin member is connected below the second fin member via the second connection member, and extends from top to bottom obliquely relative to the second connection member in the direction of the air output side, and when an orthogonal projection to a plane of any one of the fins is made, an included angle a2 between the second fin member and the first fin member is 30°~40°, an included angle a3 between the third fin member and the second fin member is 30°~40°, a length H2 of the second fin member is 1~1.5 times of a length H1 of the first fin member, and the length H2 of the second fin member is 1~1.5 times of a length H3 of the third fin member.

In some embodiments, the indoor heat exchanger further includes two side plates located at two sides of the fin set respectively, and when an orthogonal projection to a plane of any one of the fins is made, an extension line of the side plate coincides or is parallel to an extension line of the fin set, and the side plate is an integral member or a spliced member.

The window air conditioner according to embodiments of the present application includes an outdoor assembly and an indoor assembly, the outdoor assembly includes an outdoor fan and an outdoor heat exchanger, the indoor assembly includes an indoor fan and an indoor heat exchanger, and the indoor heat exchanger includes the heat exchanger according to the embodiments of the present application.

In the window air conditioner according to the embodiments of the present application, the whole machine performance and production efficiency can be improved and the production cost can be reduced.

In some embodiments, the indoor assembly further includes: a water receiving tray arranged below the indoor heat exchanger; a support member arranged at the water receiving tray and supporting the indoor heat exchanger; an indoor filter screen arranged at the air input side of the indoor heat exchanger and is located above the water receiving tray.

In some embodiments, the support member includes a first support plate and a second support plate arranged at two sides of the indoor heat exchanger respectively, one of the first support plate and the second support plate is a plastic member, and the other one thereof is a sheet metal member.

In some embodiments, the indoor filter screen includes a first sub screen and a second sub screen, the first sub screen is parallel to the first fin member or has an included angle less than or equal to 10° with the first fin member, and the second sub screen is parallel to the second fin member or has an included angle less than or equal to 10° with the second fin member.

In some embodiments, a sliding groove is arranged at the support member, and the indoor filter screen is inserted and fitted in the sliding groove.

In some embodiments, the window air conditioner further includes: a chassis, the indoor assembly and the outdoor assembly being both mounted at the chassis; a gradienter arranged at a bottom surface of the chassis and located below the indoor assembly.

In some embodiments, the chassis includes a chassis body and a bracket arranged at a bottom of the chassis body, the bracket is located at a side of the chassis body away from the outdoor assembly, and the gradienter is fixed at the bracket.

In some embodiments, the indoor assembly includes a volute assembly, the volute assembly includes a first volute and a second volute fitted with each other, the second volute is located at a rear side of the first volute, the first volute and the second volute are arranged opposite to each other and form an air channel, the air channel has an air outlet, a plane where the air outlet is located is an air output surface, and the air output surface extends obliquely rearwards from bottom to top.

In some embodiments, an angle between the air output surface and a horizontal direction is $\alpha 0$, and $\alpha 0$ satisfies: $135° \leq \alpha 0 \leq 155°$.

In some embodiments, the volute assembly further includes a motor cage, and the motor cage is connected to the first volute and the second volute.

In some embodiments, the motor cage includes a first cage body and a second cage body, the first cage body and the first volute are connected, the second cage body and the second volute are connected, and the first cage body and the second cage body are connected by a snap and/or a screw.

In some embodiments, an upper end of the first cage body and an upper end of the second cage body are connected by a second snap, a lower end of the first cage body and a lower end of the second cage body are connected by the screw, the second snap is arranged at one of the first cage body and the second cage body, a fitting hole is formed in one of the first cage body and the second cage body, the second snap is snapped in the fitting hole correspondingly, the second snap includes two third snapping hooks facing away from each other towards upper and lower sides, and the two third snapping hooks pass through the fitting hole and are snapped with edges of the fitting hole.

In some embodiments, the volute assembly further includes a bearing cover, and the bearing cover is connected to the first volute and the second volute.

In some embodiments, the bearing cover includes a first cover body and a second cover body, the first cover body and the first volute are connected, the second cover body and the second volute are connected, and the first cover body and the second cover body are connected by a snap and/or a screw.

In some embodiments, the volute assembly further includes an air guide plate, and the air guide plate is rotatably arranged at the air outlet.

In some embodiments, the volute assembly further includes a drive motor, and the drive motor is arranged at the volute assembly for driving the air guide plate to rotate.

In some embodiments, the volute assembly further includes a decorative strip, the decorative strip is located in the air outlet, an inner end of the decorative strip is connected to an end face of the air outlet, and along an air output direction, an outer end of the decorative strip extends obliquely in a direction running away from a center of the air outlet.

In some embodiments, the window air conditioner further includes a chassis, the indoor assembly and the outdoor assembly are mounted at the chassis and spaced apart from each other, a receiving groove is formed by the outdoor assembly, the indoor assembly and the chassis, the window air conditioner is configured to be supported in a window of a wall, a slidable sash is arranged in the window, and at least a part of the sash is configured to extend into the receiving groove.

In some embodiments, the window air conditioner includes a sealing assembly, and the sealing assembly is configured to contact the sash and an inner wall of the window, respectively.

Additional aspects and advantages of the present application will be given in part in the following description, and become apparent in part from the following description, or be learned from the practice of the present application.

Figure 1:
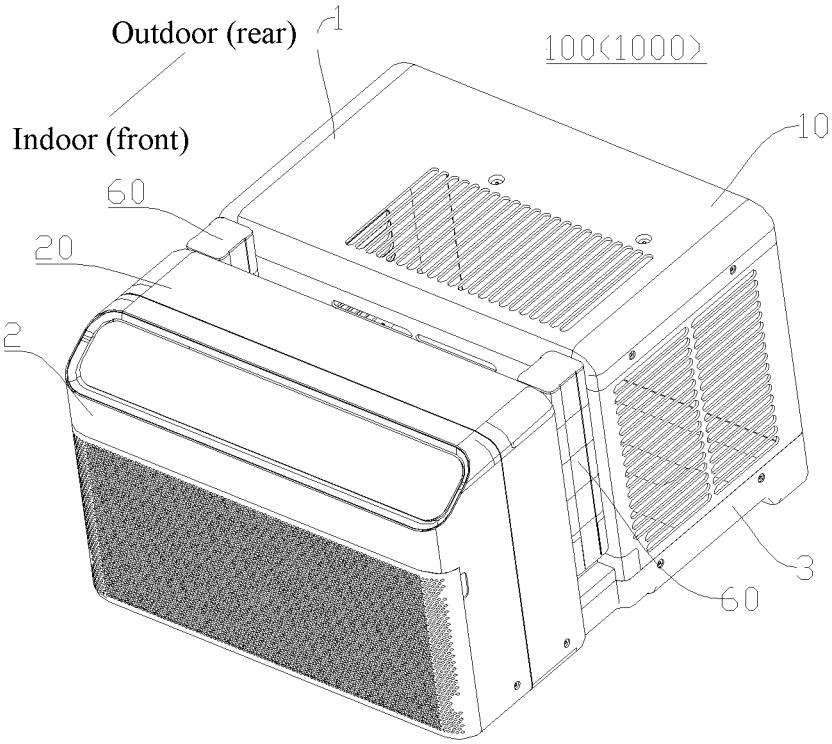
FIG. 1 is a schematic diagram of a window air conditioner according to an embodiment of the present application.

REFERENCE NUMERALS air conditioner 1000; wall 2000; window 2001; sash 2002;
window air conditioner 100; air conditioner housing 100A; air output side R2; air input side R1; receiving groove 101;
outdoor assembly 1; outdoor casing 10; outdoor fan 11; outdoor heat exchanger 12; compressor 13;
indoor assembly 2; indoor casing 20; air channel assembly 2A; air input region 201; air output region 202;
indoor fan 21; indoor heat exchanger 220;
heat exchanger 22;
fin set 221;
first fin member 221*a;* second fin member 221*b;* third fin member 221*c;*
first notch 2211; first sub notch A1; first connection member 2212;
second notch 2213; second sub notch A2; second connection member 2214;
first gap S1; second gap S2;
refrigerant pipe set 222; semicircle bent pipe section 2221; external piping section 2222;
side plate 223; first side plate 2231; second side plate 2232;
water receiving tray 23; extension member 231;
support member 24; first support plate 241; second support plate 242; sliding groove 243;
indoor filter screen 25; first sub screen 251; second sub screen 252;
air guide plate 26;
volute assembly 27;
air channel 2701; air outlet 2702; snapping groove e;
first volute 271; volute tongue body 2711; first extension plate 2712;
first snap 2713; snapping projection 27131; first snapping hook 27132;
position limit member 2714; first connection section 2715; second snapping hook 27161; snapping hole 27162;
second volute 272; volute body 2721; second extension plate 2722;
second connection section 2723;
motor cage 273; first cage body 2731; second cage body 2732; second snap 2733;
bearing cover 274; first cover body 2741; second cover body 2742; screw 275;
drive motor 281; transmission member 282; first gear 2821; second gear 2822; fitting cover 283;
chassis 3; chassis body 31; bracket 32; gradienter 4;
intermediate partition plate 5; placement space 51;
sealing assembly 60;
first connection component 601; fixation member 6011; sliding cavity d;
positioning projection 60111; sliding block 6012;
second connection component 602; insertion member 6021; insertion cavity k;
rotation support 603; positioning groove 6031; fitting plate 6032;
sliding positioning assembly 604; end cover 605;
decorative strip 70; third snap 701.

DETAILED DESCRIPTION

Embodiments of the present application are described in detail below, and examples of the described embodiments are shown in accompanying drawings. The same or similar elements or the elements having same or similar functions are denoted by the same or similar reference numerals throughout the descriptions. The following embodiments described with reference to the accompanying drawings are exemplary and are intended to explain the present application, rather than limiting the present application.

The disclosure below provides many different embodiments or examples for implementing different structures of the present application. In order to simplify the disclosure of the present application, the components and arrangements of a particular example are described below. Of course, they are only examples and are not intended to limit this application. In addition, the present application may repeat the reference numbers and/or letters in different examples. This repetition is for a purpose of simplifying and clarity and does not in itself indicate the relationship between the various embodiments and/or arrangements discussed. In addition, the present application provides examples of various specific processes and materials, but ordinary skilled in the art can realize the applicability of other processes and/or the use of other materials.

A heat exchanger 22 and a window air conditioner 100 according to embodiments of the present application are described below with reference to the accompanying drawings. The heat exchanger 22 according to the embodiments of the present application is applicable to an apparatus requiring heat exchange such as an air conditioner 1000, but the type of the air conditioner 1000 is not limited. For example, the air conditioner 1000 may be the window air conditioner 100. For example, in specific examples shown in FIGS. 1 and 2, the window air conditioner 100 may include an outdoor assembly 1 and an indoor assembly 2, the outdoor assembly 1 includes an outdoor fan 11 and an outdoor heat exchanger 12, and the indoor assembly 2 includes an indoor fan 21 and an indoor heat exchanger 220. The indoor heat exchanger 220 may adopt the heat exchanger 22 according to the embodiments of the present application. In addition, it may be understood that the window air conditioner 100 also includes a compressor 13, etc. The present application is illustrated below only by taking an example in which the heat exchanger 22 is used for the window air conditioner 100. After the technical solution of the present application has been read by those skilled in the art, it is apparent that the technical solution of the heat exchanger 22 being applied to other heat exchange apparatuses except the window air conditioner 100 can be understood.

Figure 3:
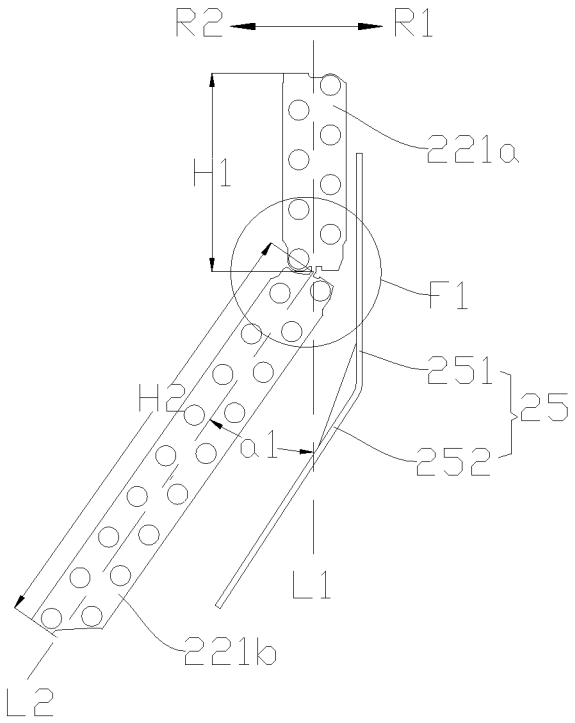
FIG. 3 is a schematic diagram of a fin set of a heat exchanger according to an embodiment of the present application.
Figure 4:
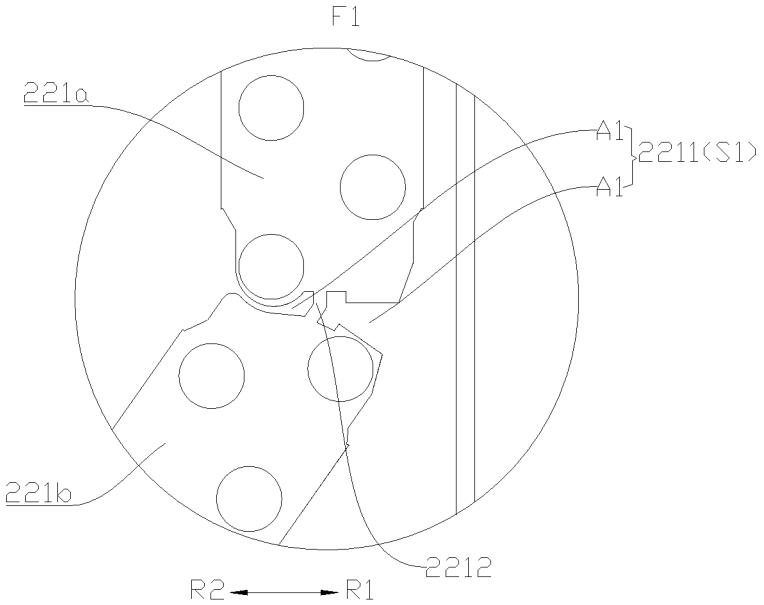
FIG. 4 is an enlarged view of a portion Fl shown in FIG. 3.
Figure 5:
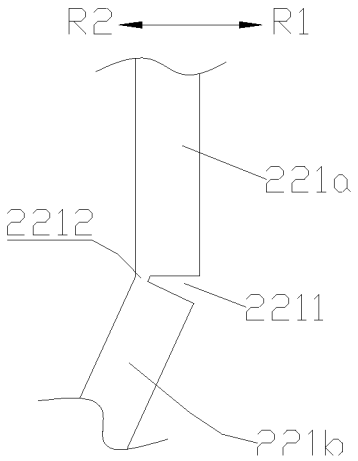
FIG. 5 is a schematic diagram of a fin set of a heat exchanger according to another embodiment of the present application.
Figure 6:
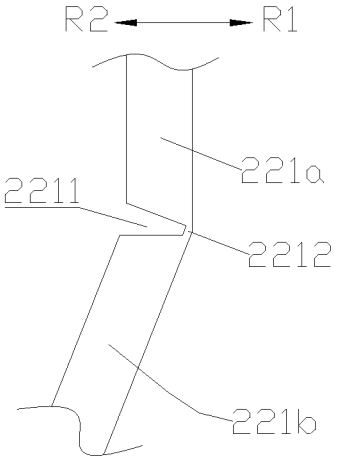
FIG. 6 is a schematic diagram of a fin set of a heat exchanger according to still another embodiment of the present application.

As shown in FIGS. 3, 4, 7, and 8, the heat exchanger 22 includes a fin set 221 and a refrigerant pipe set 222, the fin set 221 is formed by stacking a plurality of fins, and the refrigerant pipe set 222 passes through the fin set 221. The fin set 221 has a first notch 2211 and a first connection member 2212. The first notch 2211 is located at an air input side R1 and/or an air output side R2 of the first connection member 2212, that is, the first notch 2211 may be located at both the air input side R1 of the first connection member 2212 and the air output side R2 of the first connection member 2212 (as shown in FIG. 4), or the first notch 2211 may also be located only at the air input side R1 of the first connection member 2212 (as shown in FIG. 5), or the first notch 2211 may also be located only at the air output side R2 of the first connection member 2212 (as shown in FIG. 6).

Figure 7:
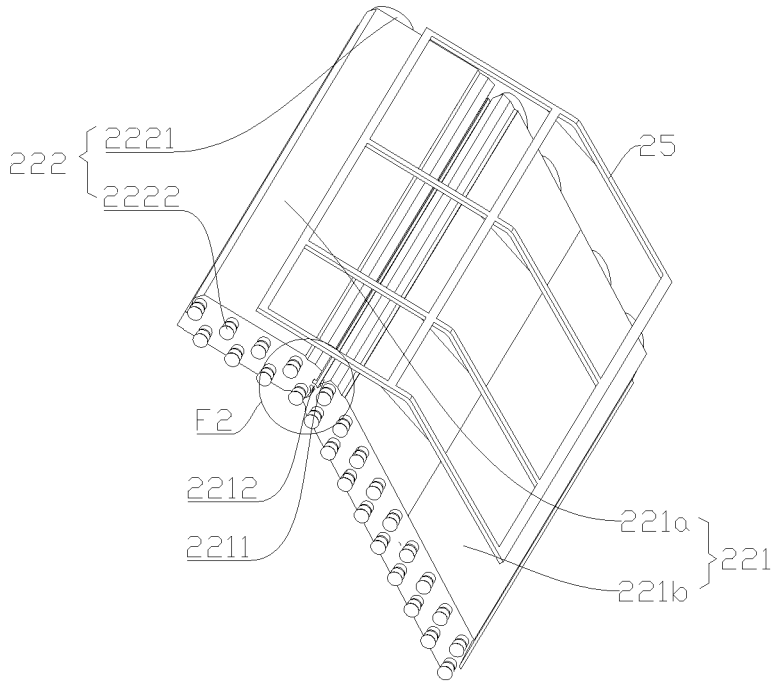
FIG. 7 is a schematic diagram of a heat exchanger and an indoor filter screen fitted with each other according to an embodiment of the present application.
Figure 8:
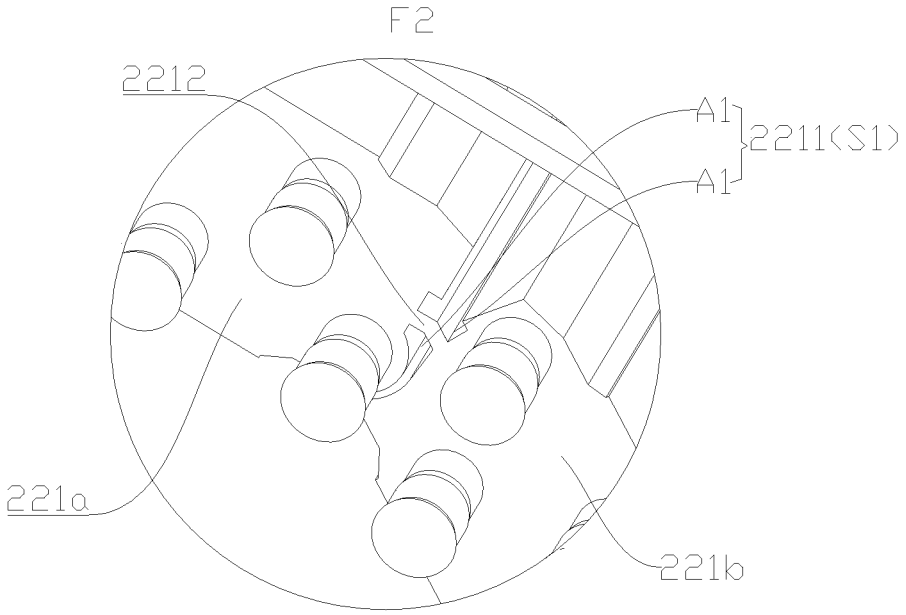
FIG. 8 is an enlarged view of a portion F2 shown in FIG. 7.

In combination with FIGS. 7 and 8, the fin set 221 is bent to a first fin member 221*a* and a second fin member 221*b* on two sides of the first notch 2211, and the first fin member 221*a* and the second fin member 221*b* are connected via the first connection member 2212 and have a non-zero included angle therebetween. That is, during processing, a plurality of integral fins with the same structure can be stacked together to form the fin set 221, and then the fin set 221 can be cut by using a special-shape cutting to obtain the first notch 2211. But the first connection member 2212 can be obtained without completely cutting off the fin set 221, and then the fin set 221 can be bent from a cutting line, namely the first notch 2211, so that the fin set 221 is divided into the first fin member 221*a* and the second fin member 221*b* on two sides of the first notch 2211. The first fin member 221*a* and the second fin member 221*b* are connected via the first connection member 2212 which is not cut off, and the first fin set 221 and the second fin set 221 have the non-zero included angle due to bending.

Therefore, the heat exchanger 22 according to the embodiments of the present application adopts the special-shape cutting and then is bent directly (for example, being bent directly by hands), and the manufacturing is very simple and convenient, thus effectively improving the manufacturing efficiency and reducing the cost. Moreover, since the first fin member 221*a* and the second fin member 221*b* are an integral cut and bent structure, so it is unnecessary for splicing, so that the filling of a sponge and a snap ring at a spliced place is avoided, so as to avoid the influence of the sponge and the snap spring on the heat exchange, thus improving the heat exchange, and enhancing the uniformity of air supply, and facilitating the smooth discharge of condensate water. In addition, due to the elimination of the snap spring and the sponge, the number of used components is reduced, so that the assembling efficiency is improved and the production cost is reduced. Therefore, the whole machine performance and the production efficiency of the window air conditioner 100 can be improved, and the production cost of the window air conditioner 100 can be reduced.

In some embodiments of the present application, in combination with FIG. 4, after the fin set 221 is molded by bending, there is a gap between the first fin member 221*a* and the second fin member 221*b* at the first notch 2211. That is, the first fin member 221*a* and the second fin member 221*b* having the non-zero included angle therebetween have a first gap S1 at a position (including positions of two first sub notches A1 described later) of the first notch 2211. It is shown that during the whole bending process, the first fin member 221*a* and the second fin member 221*b* do not interfere with each other, and there is not a problem that fins will interfere with each other and thus collapse at the first notch 2211. For example, the above requirement can be met by using the special-shape cutting. Therefore, it is more conducive to improving the heat exchange, enhancing the uniformity of air supply and facilitating the smooth discharge of condensate water.

In some embodiments of the present application, in combination with FIG. 4, the first notch 2211 may include two first sub notches A1, and the two first sub notches A1 are respectively arranged at the air input side R1 and the air output side R2 of the first connection member 2212. Thus, the first gap S1 of the first fin member 221*a* and the second fin member 221*b* at the first notch 2211 can be reduced, thus further improving the heat exchange, enhancing the uniformity of air supply and facilitating the smooth discharge of condensate water.

In some embodiments of the present application, as shown in FIG. 3, the first fin member 221*a* can extend vertically from top to bottom, and the second fin member 221*b* can be connected below the first fin member 221*a* through the first connection member 2212, and extend from top to bottom obliquely relative to the first fin member 221*a* in a direction of the air output side R2. When an orthogonal projection to a plane of any of the fins is made, an included angle a1 between (a length extension line L1 of) the first fin member 221*a* and (a length extension line L2 of) the second fin member 221*b* is 25°~45°, and a length H2 of the second fin member 221*b* is 2-3 times of a length H1 of the first fin member 221*a*. Thus, the structural layout and the design requirement of the window air conditioner 100 can be well met, and a better heat exchange effect is achieved. For example, the heat exchange area of the indoor heat exchanger 220 is increased, the heat exchange efficiency is improved, and thus the energy efficiency of the window air conditioner 100 is improved.

Figure 11:
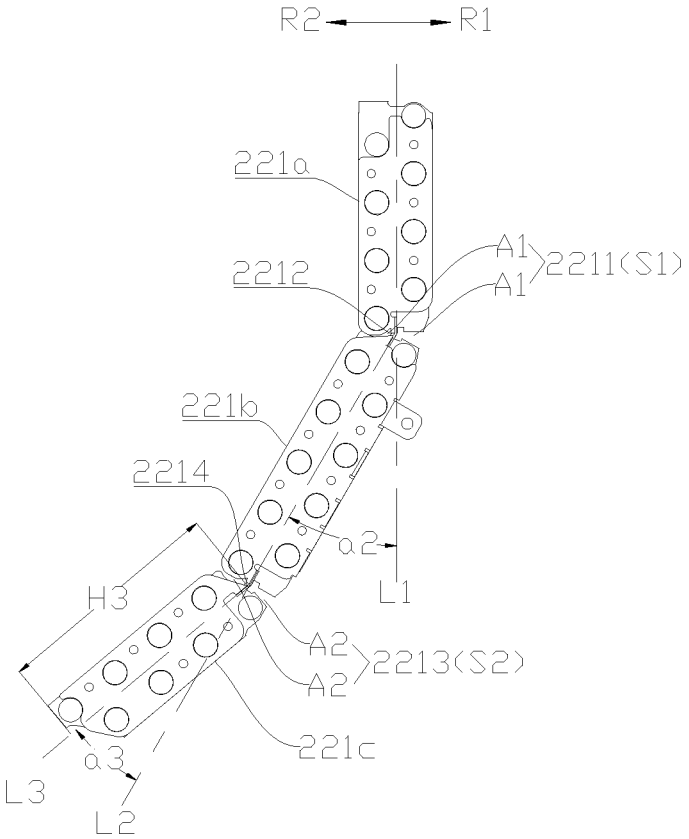
FIG. 11 is a schematic diagram of a heat exchanger according to another embodiment of the present application.
Figure 12:
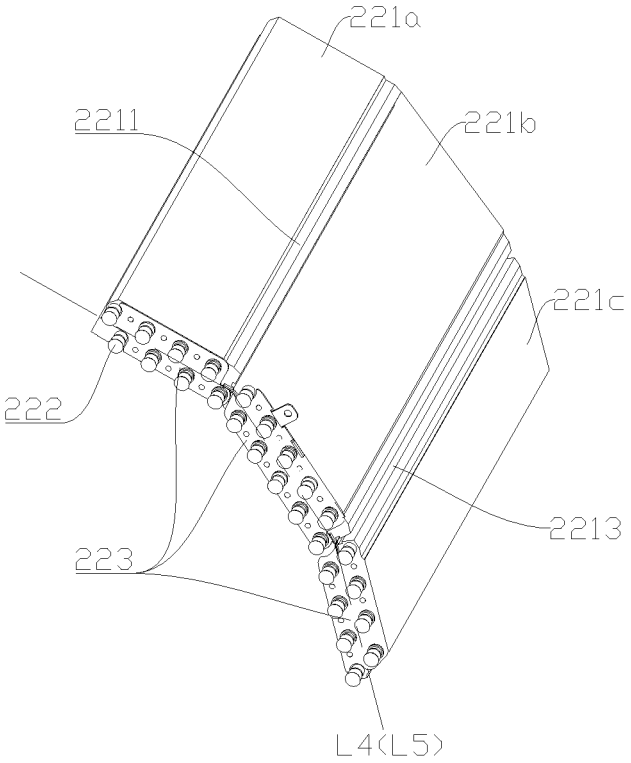
FIG. 12 is a perspective view of the heat exchanger shown in FIG. 11.

In some embodiments of the present application, as shown in FIGS. 11 and 12, the fin set 221 may also have a second notch 2213 and a second connection member 2214, and the second notch 2213 is located at an air input side R1 and/or an air output side R2 of the second connection member 2214. That is, the second notch 2213 may be located at both the air input side R1 of the second connection member 2214 and the air output side R2 of the second connection member 2214, or, the second notch 2213 may also be located only at the air input side R1 of the second connection member 2214, or the second notch 2213 may also be located only at the air output side R2 of the second connection member 2214.

In combination with FIG. 11, the fin set 221 is bent to a second fin member 221*b* and a third fin member 221*c* on two sides of the second notch 2213, that is, the second fin member 221*b* is located between the first notch 2211 and the second notch 2213, the first fin member 221*a* and the third fin member 221*c* are arranged at two sides of the second fin member 221*b*, and the second fin member 221*b* and the third fin member 221*c* are connected via the second connection member 2214 and have a non-zero included angle therebetween.

During processing, a plurality of integral fins with the same structure can be stacked together to form the fin set 221, and then the fin set 221 is cut by using the special-shape cutting to obtain the first notch 2211 and the second notch 2213. But the first connection member 2212 and the second connection member 2214 can be obtained without completely cutting off the fin 221, and then the fin set 221 can be bent respectively from the cutting lines, namely the first notch 2211 and the second notch 2213, so that the fin set 221 is divided into the first fin member 221*a* and the second fin member 221*b* on two sides of the first notch 2211, as well as the second fin member 221*b* and the third fin member 221*c* on two sides of the second notch 2213. The second fin member 221*b* is located between the first notch 2211 and the second notch 2213. The first fin member 221*a* and the second fin member 221*b* are connected via the first connection member 2212 which is not cut off, and the first fin set 221 and the second fin set 221 have the non-zero included angle therebetween due to bending. The second fin member 221*b* and the third fin member 221*c* are connected via the second connection member 2214 which is not cut off, and the second fin set 221 and the third fin set 221 have the non-zero included angle therebetween due to bending.

In some embodiments of the present application, after the fin set 221 is molded by bending, there is a gap between the second fin member 221*b* and the third fin member 221*c* at the second notch 2213. That is, the second fin member 221*b* and the third fin member 221*c* having the non-zero included angle therebetween have a second gap S2 at a position (including positions of two second sub notches A2 described later) of the second notch 2213. It is shown that during the whole bending process, the second fin member 221*b* and the third fin member 221*c* do not interfere with each other, and there is not a problem that the fins will interfere with each other and collapse at the second notch 2213. For example, the above requirement can be met by using the special-shape cutting. Therefore, it is more conducive to improving the heat exchange, enhancing the uniformity of air supply and facilitating the smooth discharge of condensate water.

In some embodiments of the present application, the second notch 2213 may include two second sub notches A2, and the two second sub notches A2 are respectively arranged at the air input side R1 and the air output side R2 of the second connecting unit 2214. Thus, the second gap S2 of the second fin member 221*b* and the third fin member 221*c* at the second notch 2213 can be reduced, thus further improving the heat exchange, enhancing the uniformity of air supply and facilitating the smooth discharge of condensate water.

In some embodiments of the present application, as shown in FIG. 11, the first fin member 221*a* may extend vertically from top to bottom. The second fin member 221*b* may be connected below the first fin member 221*a* via the first connection member 2212, and extend from top to bottom obliquely relative to the first fin member 221*a* in the direction of the air output side R2; the third fin member 221*c* can be connected below the second fin member 221*b* through the second connection member 2214, and extend from top to bottom obliquely relative to the second connection member 2214 in the direction of the air output side R2.

As shown in FIG. 11, when an orthogonal projection to a plane of any of the fins is made, an included angle a2 between (a length extension line L1 of) the first fin member 221*a* and (a length extension line L2 of) the second fin member 221*b* is 30°~40°, and an included angle a3 between (a length extension line L3 of) the second fin member 221*b* and (a length extension line L2 of) the third fin member 221*c* is 30°~40°. A length H2 of the second fin member 221*b* is 1~1.5 times of a length H1 of the first fin member 221*a*, and the length H2 of the second fin member 221*b* is 1~1.5 times of a length H3 of the third fin member 221*c*. Thus, the structural layout and the design requirement of the window air conditioner 100 can be well met, and a better heat exchange effect can be achieved.

In some embodiments of the present application, as shown in FIGS. 11 and 12, the heat exchanger 22 may also include two side plates 223 respectively located at two sides of the fin set 221. When an orthogonal projection to a plane of any of the fins is made, an extension line L4 of the side plate 223 coincides or is parallel to an extension line L5 of the fin set 221, that is, the number of the fin members molded by bending the fin set 221 is the same as the number of sub plates included in the side plate 223, which extend respectively in the same direction as the fin members. Therefore, the side plate 223 can be used to strengthen the fixing of the shape of the bent fin set 221, and the heat exchanger 22 can be mounted in the window air conditioner 100 by using the side plate 223.

In addition, it is necessary to note that the side plate 223 may be an integral member or a spliced member. When the side plate 223 is the integral member, the side plate 223 may be formed by cutting through a cutting process, and the side plate 223 may also be processed by a process similar to the fin set 221, in which the side plate 223 is cut by using the special-shape cutting first and then is molded by bending. Moreover, two side plates 223 may be fixed at two sides of the fin set 221 respectively, and then the side plate 223 and the fin set 221 are cut simultaneously by using the special-shape cutting and bent simultaneously, thus simply and effectively ensuring that the extension line L4 of the side plate 223 coincides or is parallel to the extension line L5 of the fin set 221. Of course, the present application is not limited to this. The side plate 223 and the fin set 221 may also be processed respectively and then assembled. In addition, when the side plate 223 is the spliced member, which indicates that the side plate 223 includes a plurality of separately molded plate pieces, the plurality of plate pieces is arranged at corresponding included angles according to the extension line of the fin set 221, and then is connected with each other, or, the plurality of plate pieces may be directly mounted at the fin set 221 respectively.

Figure 13:
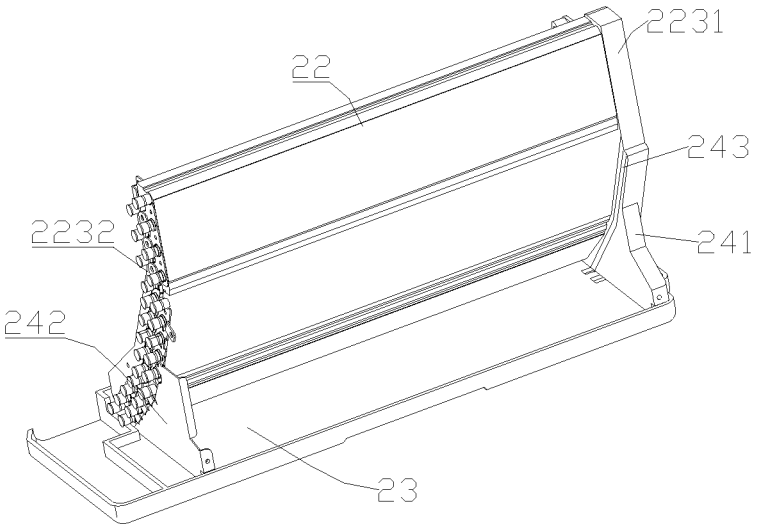
FIG. 13 is a schematic diagram of the heat exchanger shown in FIG. 12, which is fitted with a water receiving tray and a support member.
Figure 14:
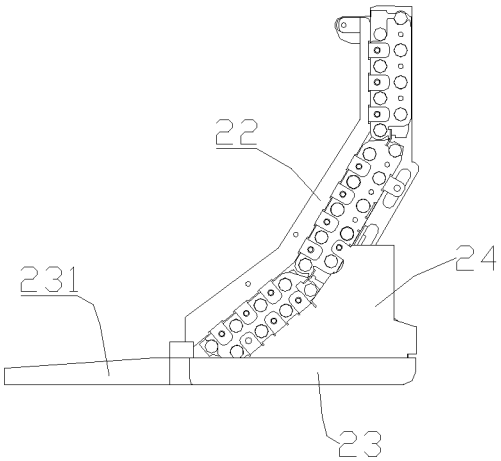
FIG. 14 is a side view of the heat exchanger, etc. shown in FIG. 13.
Figure 15:
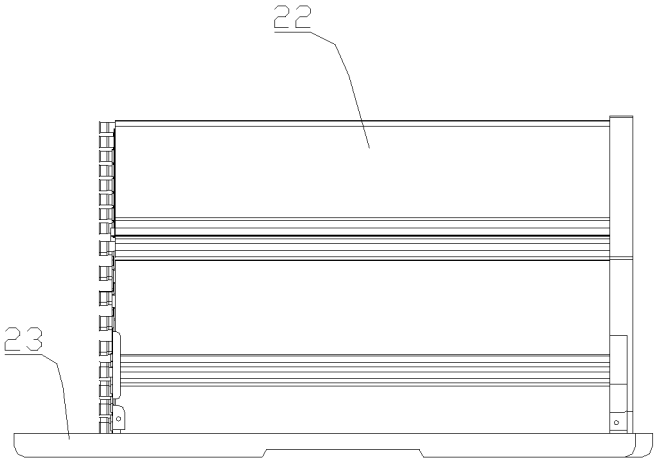
FIG. 15 is a front view of the heat exchanger, etc. shown in FIG. 13.
Figure 16:
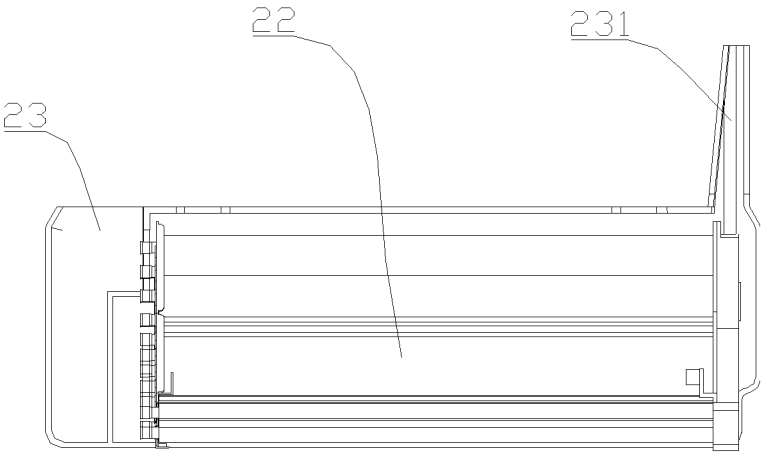
FIG. 16 is a top view of the heat exchanger, etc. shown in FIG. 13.

In some embodiments of the present application, as shown in FIG. 13, the indoor assembly 2 may also include a water receiving tray 23, a support member 24 and an indoor filter screen 25. The water receiving tray 23 is arranged below the heat exchanger 22, the support member 24 is arranged at the water receiving tray 23 and supports the heat exchanger 22, and the indoor filter screen 25 is arranged at the air input side R1 of the heat exchanger 22 and located above the water receiving tray 23. Therefore, the indoor filter screen 25 can be used to ensure the cleanness of the airflow flowing to the heat exchanger 22, thus avoiding the dirty air from blocking the fin set 221, and ensuring the heat exchange efficiency of the heat exchanger 22. Moreover, the water receiving tray 23 can be used to undertake the water dropped from the heat exchanger 22, and guide the water to the outdoor (for example, an extension member 231 extending toward an outdoor side on the water receiving tray 23 can be used to realize the water drainage). Thus, the working reliability of window air conditioner 100 can be ensured.

Figure 9:
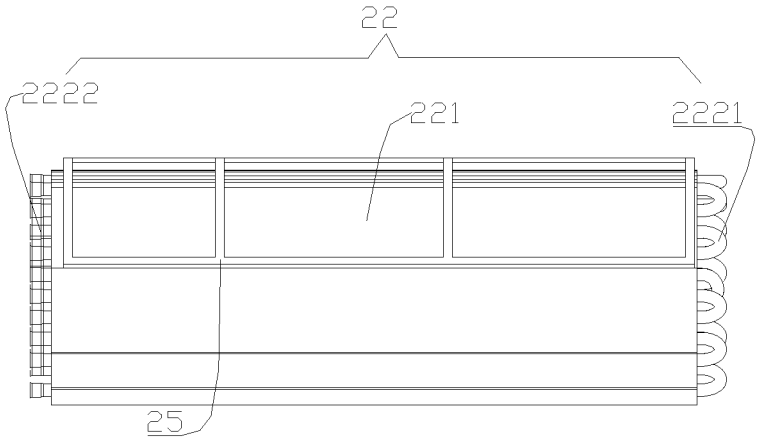
FIG. 9 is a bottom view of the heat exchanger and the indoor filter screen fitted with each other shown in FIG. 7.
Figure 10:
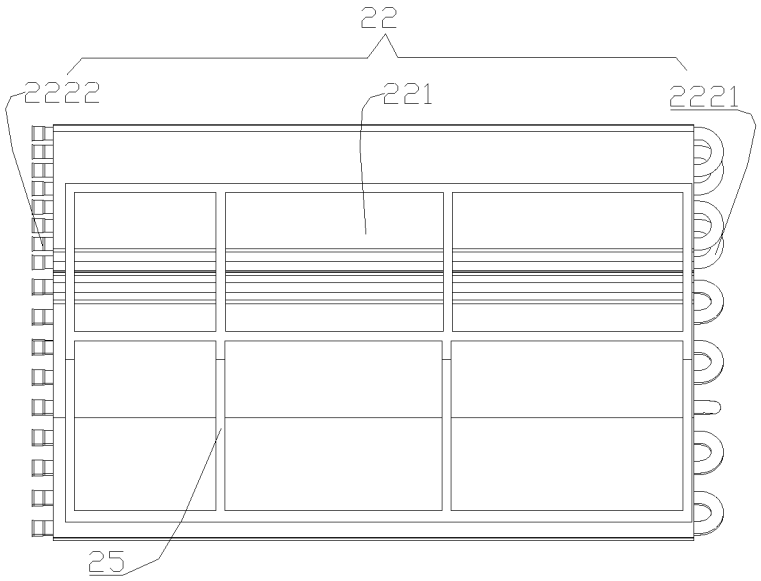
FIG. 10 is a front view of the heat exchanger and the indoor filter screen fitted with each other shown in FIG. 7.

In some embodiments of the present application, as shown in FIG. 13, the water receiving tray 23 may be a foam member, thus avoiding a condensation dew generated on an outer side the water receiving tray 23. The support member 24 may include a first support plate 241 and a second support plate 242 respectively arranged at two sides of the heat exchanger 22, one of the first support plate 241 and the second support plate 242 is a plastic member and the other one thereof is a sheet metal member. Specifically, the first support plate 241 and the second support plate 242 may be connected to the two side plates 223 (a first side plate 2231 and a second side plate 2232 respectively) of the heat exchanger 22 respectively. In combination with FIG. 9, a semicircle bent pipe section 2221 of the refrigerant pipe set 222 is arranged at and passes through the first side plate 2231, and an external piping section 2222 of the refrigerant pipe set 222 is arranged at and passes through the second side plate 2232. In this case, the first support plate 241 connected to the first side plate 2231 may be made of plastic, thus reducing the cost, and the second support plate 242 connected to the second side plate 2232 may be made of sheet metal, thus avoiding the deformation of the second support plate 242 caused by a high temperature while welding the external piping section 2222.

In some embodiments of the present application, in combination with FIG. 3, the indoor filter screen 25 includes a first sub screen 251 and a second sub screen 252, the first sub screen 251 is parallel to the first fin member 221*a* or has an included angle less than or equal to 10° with the first fin member 221*a*, and the second sub screen 252 is parallel to the second fin member 221*b* or has an included angle less than or equal to 10° with the second fin member 221*b*.

Therefore, the cost of the indoor filter screen 25 can be reduced and the filtration reliability of the indoor filter screen 25 can be improved. In addition, the indoor filter screen 25 is arranged parallel or substantially parallel to the fin set 221, so that the air input from the indoor filter screen 25 to the heat exchanger 22 can be more uniform and the vortex can be reduced, which is conducive to reducing the air input noise. In addition, when the fin set 221 also includes the third fin member 221*c*, the indoor filter screen 25 may also include a third sub screen, and the third sub screen is parallel to the third fin member 221*c* or has an included angle within 10° with the third fin member 221*c*.

In some embodiments of the present application, a distance between the first sub screen 251 and the first fin member 221*a* is d1, a distance between the second sub screen 252 and the second fin member 221*b* is d2, d1 and d2 satisfy: $0.9 \leq d1/d2 \leq 1.2$. For example, d1/d2 is 0.91, 0.95, 0.99, 1, 1.11 and other parameters. Therefore, it is beneficial to further reducing the generation of the vortex and reducing the noise.

In some embodiments of the present application, as shown in FIG. 13, a sliding groove 243 may be provided on the support member 24, and the indoor filter screen 25 is inserted and fitted in the sliding groove 243. Thus, the assembling and positioning of the indoor filter screen 25 can be realized simply and effectively. Moreover, by limiting an extension direction of the sliding groove 243, it can be simply and effectively ensured that the shape of the indoor filter screen 25 is parallel or substantially parallel to the heat exchanger 22. Of course, this application is not limited to this. The sliding groove 243 may also be arranged in other positions inside the window air conditioner 100 to facilitate the assembling of the indoor filter screen 25.

Figure 17:
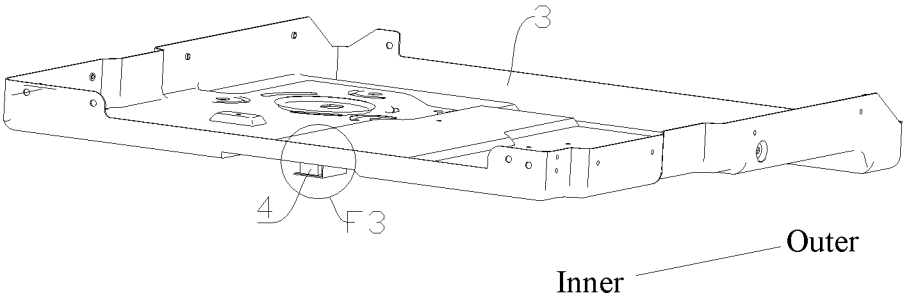
FIG. 17 is an assembly view of a chassis and a gradienter according to an embodiment of the present application.
Figure 18:
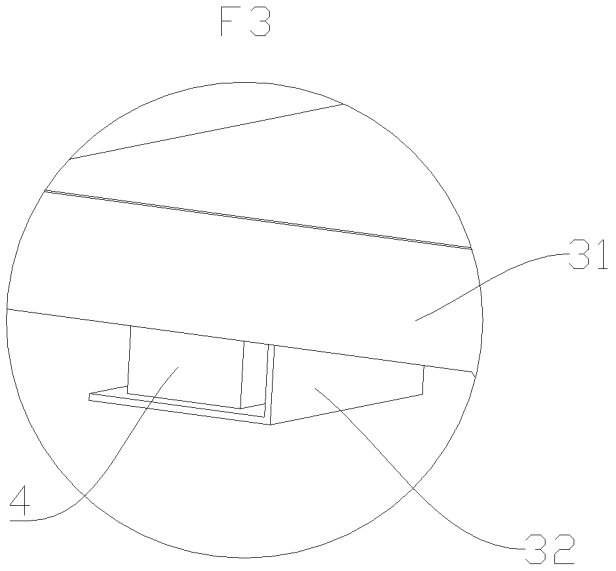
FIG. 18 is an enlarged view of a portion F3 shown in FIG. 17.

In some embodiments of the present application, as shown in FIGS. 17-18, the window air conditioner 100 may also include a chassis 3 and a gradienter 4. The indoor assembly 2 and outdoor assembly 1 are both mounted at the chassis 3, and the gradienter 4 is arranged at a bottom surface of the chassis 3 and is located below the indoor assembly 2. Thus, it is convenient for users to understand the level of mounting of the window air conditioner 100 clearly, so as to ensure that the window air conditioner 100 can tilt slightly downwards towards the outdoor side, thus facilitating the water drainage.

Figure 19:
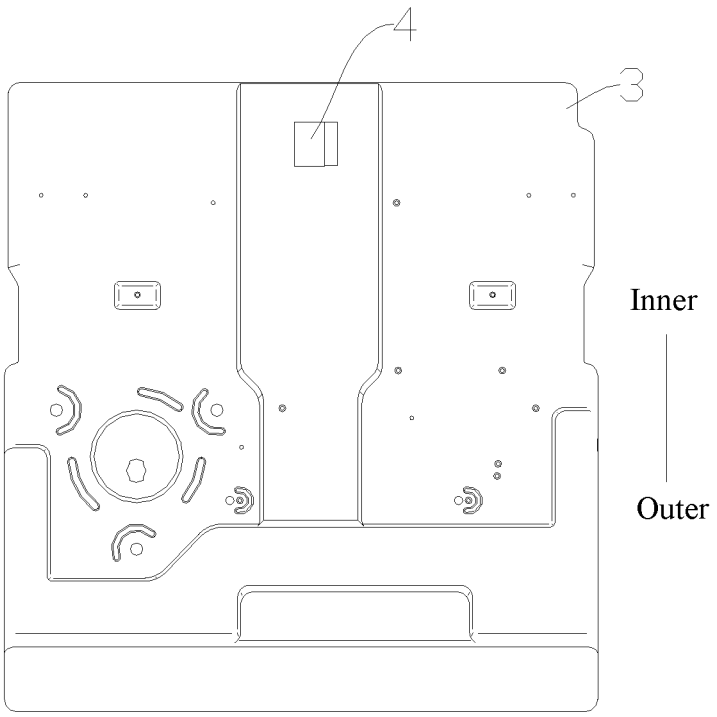
FIG. 19 is a bottom view of the chassis and the gradienter shown in FIG. 17.
Figure 20:
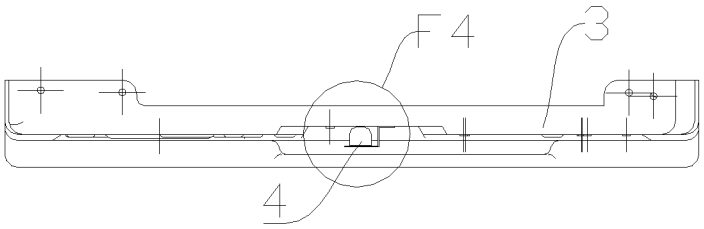
FIG. 20 is a front view of the chassis and the gradienter shown in FIG. 17.
Figure 21:
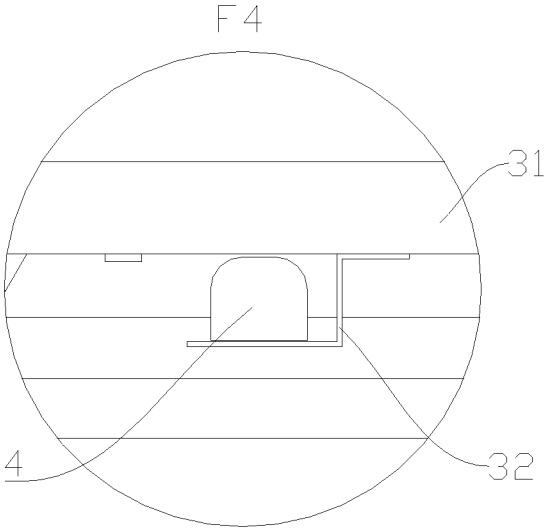
FIG. 21 is an enlarged view of a portion F4 shown in FIG. 20.

As shown in FIGS. 19-21, the chassis 3 includes a chassis body 31 and a bracket 32 arranged at a bottom of the chassis body 31. The bracket 32 is located at a side of the chassis body 31 away from the outdoor assembly 1, and the gradienter 4 is fixed at the bracket 32. Thus, the mounting of the gradienter 4 on an edge of the chassis 3 adjacent to an indoor side of the chassis 3 is realized simply and effectively, to further facilitate the observation of the user. In addition, the connection manner of the bracket 32 and the chassis body 31 is not limited, for example, it may be spot welding or threaded connection, etc.

Figure 2:
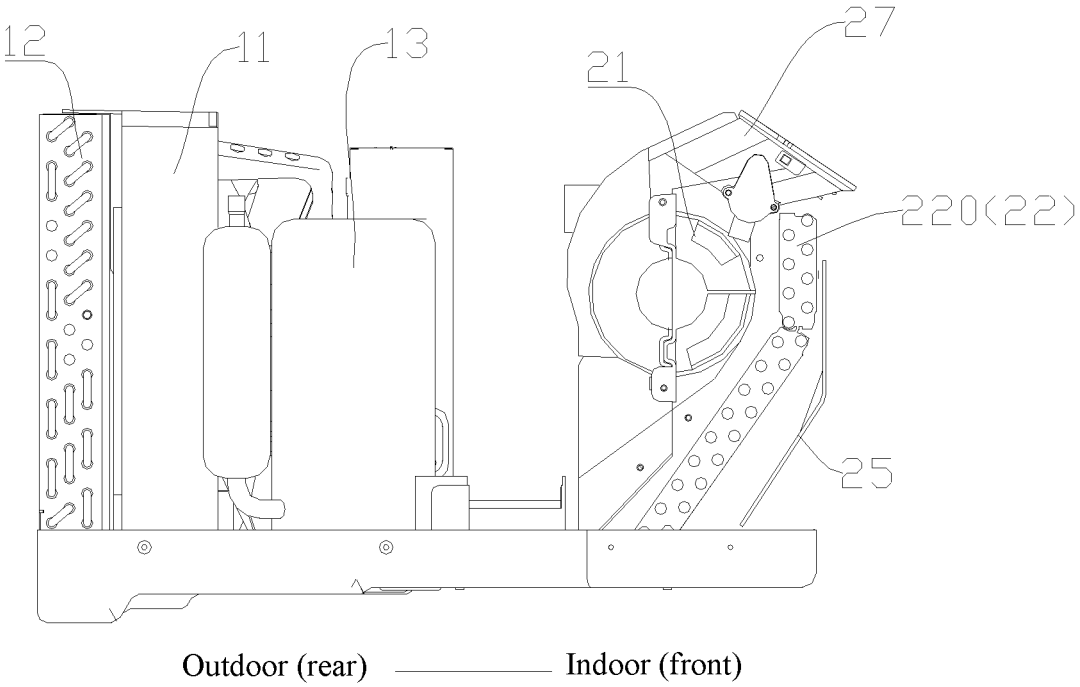
FIG. 2 is a schematic diagram of an internal structure of the window air conditioner shown in FIG. 1.

As shown in FIG. 2, the window air conditioner 100 according to the embodiments of the present application includes a volute assembly 27.

Figure 22:
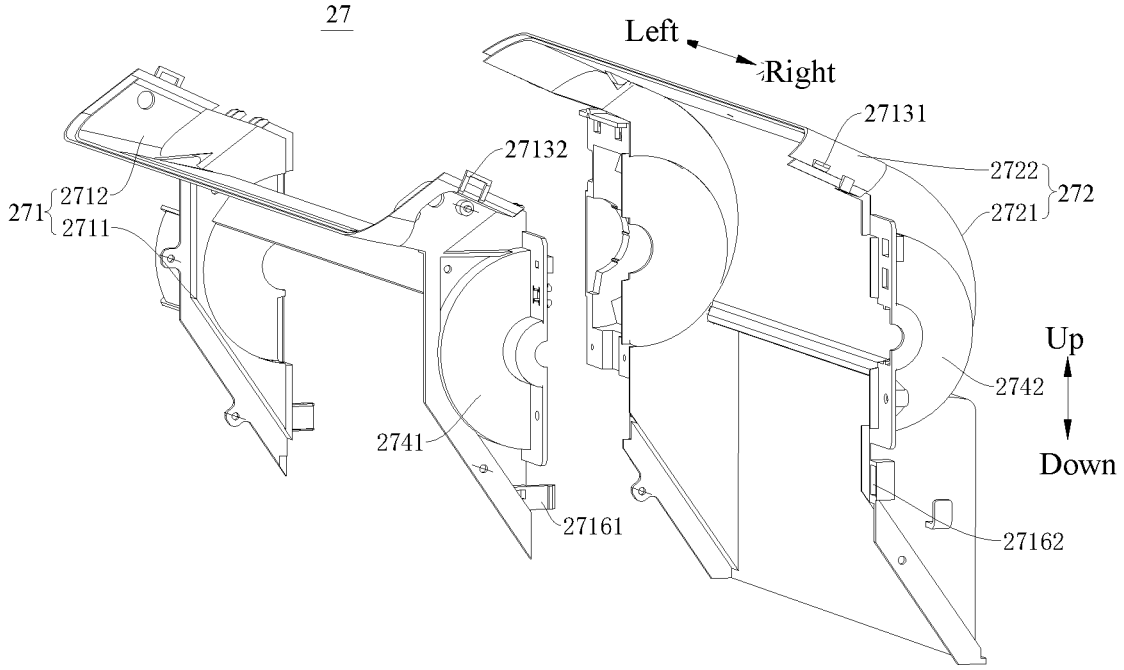
FIG. 22 is an exploded view of a volute assembly according to an embodiment of the present application.

In combination with FIG. 22, the volute assembly 27 includes a first volute 271 and the second volute 272, and the first volute 271 and the second volute 272 are fitted and connected with each other. For example, the first volute 271 and the second volute 272 are detachably connected, and the second volute 272 is located at a rear side of the first volute 271. The first volute 271 and the second volute 272 are arranged opposite to each other, the first volute 271 and the second volute 272 together form an air channel 2701, and the air channel 2701 has an air outlet 2702.

A plane where the air outlet 2702 is located is an air output surface, and the air output surface extends obliquely rearwards from bottom to top. The volute assembly 27 is used in the window air conditioner 100, which can shorten a length of the air channel 2701, thus reducing a length of a flow path of an airflow in the air channel 2701, and reducing the flow loss of the airflow and increasing the air supply distance. Moreover, the space occupied by the volute assembly 27 in a height direction can be reduced. In addition, the air outlet 2702 can supply the air in an inclined upward direction, so as to avoid the cold air from sinking and directly blowing to people. The inclined air output surface can also increase an air output area, enhance the air output effect and improve the working performance of the air conditioner 1000.

In the window air conditioner 100 according to the embodiments of the present application, the air output surface of the air outlet 2702 is arranged at extend obliquely rearwards from bottom to top, so as to shorten a length of the air channel 2701, reduce the flow loss of the airflow, increase the air supply distance, and allow the air outlet 2702 to supply the air in the inclined upward direction, thus avoiding the cold air from directly blowing to people, reducing the space occupied by the volute assembly 27 in height and improving the air output effect. It is necessary to note that the first volute 271 and the second volute 272 are both separately molded members. Thus, by configuring the volute assembly 27 into the first volute 271 and the second volute 272 molded separately, it is convenient to assemble components in the air channel 2701, for example, the mounting operations of an air guide plate and the indoor fan 21 in the air channel 2701 can be more convenient. Moreover, the processing and manufacturing of the first volute 271 and the second volute 272 can be convenient, and the manufacturing difficulty is reduced.

The expression "the first volute 271 and the second volute 272 are both separately molded members" refers to that the first volute 271 and the second volute 272 are processed separately, and then assembled and fixed. For example, the first volute 271 and the second volute 272 are injection molded members respectively. After being injection molded, the first volute 271 and the second volute 272 are fixed by a plurality of screw fasteners (e.g., by using two screw fasteners). For example, the first volute 271 and the second volute 272 are injection molded members respectively. A hook is integrally formed on the first volute 271, and a snapping hole fitted with the hook is integrally formed in the second volute 272. The fixed connection between the first volute 271 and the second volute 272 is realized by the fit of the hook and the snapping hole. For example, the first volute 271 and the second volute 272 are sheet metal members or castings respectively.

Compared with a volute device in the related art in which a volute tongue strip is connected to a circumferential surface of a volute air channel, the volute assembly 27 of the window air conditioner 100 according to the embodiments of the present application is formed by the first volute 271 and the second volute 272 connected and fitted with each other. The first volute 271 and the second volute 272 are respectively formed into separate components. As shown in FIG. 22, a junction of the first volute 271 and the second volute 272 is located in the middle of either end of the air channel 2701 and is not at a position of the air channel 2701, and a joint of the first volute 271 and the second volute 272 is approximately L-shaped. That is, the joint extends upwards and forwards from a lower end of the volute assembly 27 on a cross section of the volute assembly 27 perpendicular to the air channel 2701. In other words, an extension direction of the joint is consistent with an extension direction of the cross section of the volute assembly 27 perpendicular to the air channel 2701 in the up and down direction. In this way, the air will not leak out of the volute assembly 27 when flowing in the air channel 2701, which can ensure the airtightness of the flowing air in the air channel 2701, thus ensuring the air output effect and avoiding the possible abnormal sound caused by the assembling clearance.

Figure 23:
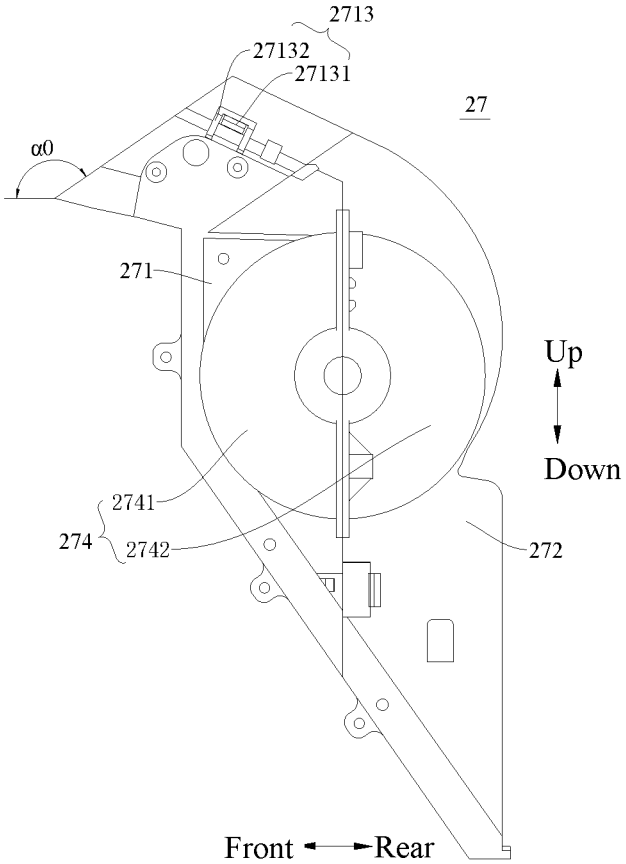
FIG. 23 is a side view of the volute assembly shown in FIG. 22.

According to some embodiments of the present application, referring to FIG. 23, an angle between the air output surface and a horizontal direction is $\alpha 0$, and $\alpha 0$ satisfies: $135° \leq \alpha \leq 155°$. For example, $\alpha 0$ may be 135°, 138°, 140°, 143°, 145°, 148°, 150°, 153°, and 155°. Therefore, by setting the included angle between the air output surface and the horizontal direction in the above range, the air output surface can have a large air output area. In addition, while the flow path of the airflow in the air conditioner 1000 is shortened, the cold air is prevented from directly blowing to people, and also the air outlet 2702 is allowed to supply the air in an inclined forward direction at a suitable angle.

Figure 24:
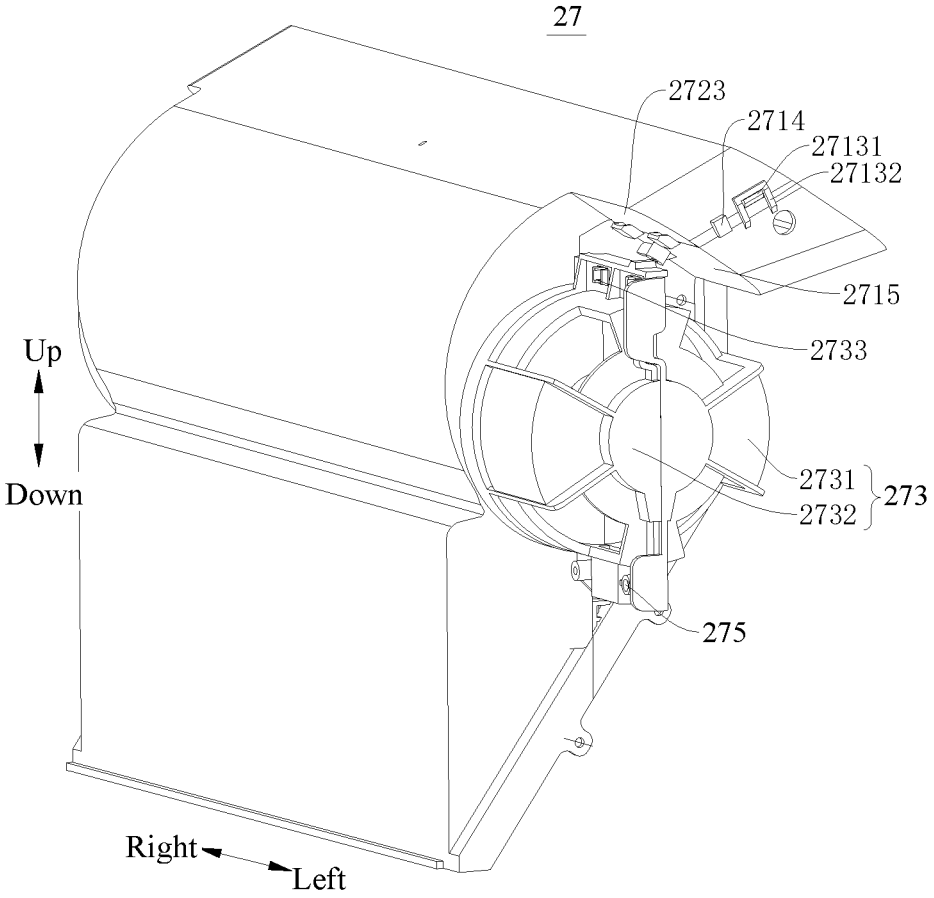
FIG. 24 is a perspective view of the volute assembly shown in FIG. 22.

As shown in FIG. 24, according to some embodiments of the present application, the first volute 271 includes a volute tongue body 2711 and a first extension plate 2712, the first extension plate 2712 is arranged at an upper end of the volute tongue body 2711, and the first extension plate 2712 extends forwards along an air output direction. The second volute 272 includes a volute body 2721 and a second extension plate 2722, the second extension plate 2722 is arranged at an upper end of the volute body 2721, and the first extension plate 2712 extends forwards along the air output direction. The volute tongue body 2711 and the volute body 2721 are fitted and connected with each other to form the air channel 2701, the first extension plate 2712 and the second extension plate 2722 are fitted and connected with each other to form the air outlet 2702, and the air outlet 2702 and the air channel 2701 are communicated with each other. According to some embodiments of the present application, the first extension plate 2712 and the second extension plate 2722 may be engaged with each other, which facilitates the assembling of the first extension plate 2712 and the second extension plate 2722, and can reduce the number of components. For example, the number of screws 275 is reduced and the assembling efficiency is improved.

As shown in FIG. 24, according to some embodiments of the present application, a left end of the first extension plate 2712 and a left end of the second extension plate 2722 are fitted and connected with each other by a first snap 2713 and a position limit member 2714, and a right end of the first extension plate 2712 and a right end of the second extension plate 2722 are fitted and connected with each other by the first snap 2713 and the position limit member 2714. The first snap 2713 is used to connect the first extension plate 2712 with the second extension plate 2722, and the position limit member 2714 may be used for pre-positioning of mounting. As shown in FIG. 24, according to some embodiments of the present application, the first snap 2713 includes a snapping projection 27131 and a first snapping hook 27132. The snapping projection 27131 is arranged at one of the first extension plate 2712 and the second extension plate 2722, and the first snapping hook 27132 is arranged at the other one of the first extension plate 2712 and the second extension plate 2722. For example, the snapping projection 27131 is arranged at the second extension plate 2722, and the first snapping hook 27132 is arranged at the first extension plate 2712. When the first extension plate 2712 and the second extension plate 2722 are assembled, the first snapping hook 27132 and the snapping projection 27131 are fitted and connected with each other, that is, the first snapping hook 27132 hooks a side of the snapping projection 27131 away from the first extension plate 2712.

According to some embodiments of the present application, the position limit member 2714 is arranged at one of the first extension plate 2712 and the second extension plate 2722 to limit an edge of the other one of the first extension plate 2712 and the second extension plate 2722. As shown in FIG. 22, the position limit member 2714 is arranged at the second extension plate 2722 and is arranged adjacent to the joint of the first extension plate 2712 and the second extension plate 2722. When the first extension plate 2712 and the second extension plate 2722 are assembled, the position limit members 2714 at left and right ends of the second extension plate 2722 can limit left and right ends of the first extension plate 2712, so as to facilitate the connection of the first extension plate 2712 and the second extension plate 2722 through the first snap 2713, and also to prevent the first extension plate 2712 and the second extension plate 2722 from being separated from each other, ensuring thus the reliability of the connection.

In some embodiments, as shown in FIG. 24, the first volute 271 also includes two first connection sections 2715, and in a left and right direction, two ends of the first extension plate 2712 extend beyond the volute tongue body 2711 towards two sides, respectively. As shown in FIG. 24, in the left and right direction, a length of the first extension plate 2712 is greater than a length of the volute tongue body 2711, and the volute tongue body 2711 is connected to a middle portion of the first extension plate 2712. The first connection section 2715 at a left end is connected between a left end of the volute tongue body 2711 and the first extension plate 2712, and the first connection section 2715 at a right end is connected between a right end of the volute tongue body 2711 and the first extension plate 2712. The first connection section 2715 located at the left end of the volute tongue body 2711 is used for a transition between the left end of the volute tongue body 2711 and the first extension plate 2712, and the first connection section 2715 located at the right end of the volute tongue body 2711 is used for a transition between the right end of the volute tongue body 2711 and the first extension plate 2712, so as to ensure the natural connection and the airtightness of the air channel 2701.

In some embodiments, as shown in FIG. 24, the second volute 272 also includes two second connection sections 2723, and in the left and right direction, two ends of the second extension plate 2722 extend beyond the volute body 2721 towards two sides, respectively. As shown in FIG. 24, in the left and right direction, a length of the second extension plate 2722 is greater than a length of the volute body 2721, and the volute body 2721 is connected to a middle portion of the second extension plate 2722. The second connection section 2723 at a left end is connected between a left end of the volute body 2721 and the second extension plate 2722, and the second connection section 2723 at a right end is connected between a right end of the volute body 2721 and the second extension plate 2722. The second connection section 2723 located at the left end of the volute body 2721 is used for a transition between the left end of the volute body 2721 and the second extension plate 2722, and the second connection section 2723 located at the right end of the volute body 2721 is used for a transition between the right end of the volute body 2721 and the second extension plate 2722, so as to ensure the natural connection and the airtightness of the air channel 2701.

In some embodiments, as shown in FIG. 24, the second connection section 2723 and the corresponding first connection section 2715 are connected by a snap, i.e., the second connection section 2723 at the left end and the first connection section 2715 at the left end are connected by the snap, and the second connection section 2723 at the right end and the first connection section 2715 at the right end are connected by the snap, so as to facilitate the assembling of the first connection section 2715 and the corresponding second connection section 2723, and reduce the number of components for connection.

In some embodiments, as shown in FIG. 22, a second snapping hook 27161 is arranged at one of the volute tongue body 2711 and the volute body 2721, and a snapping hole 27162 penetrated through in a front and rear direction is formed in the other one of the volute tongue body 2711 and the volute body 2721. For example, the second snapping hook 27161 is arranged at the volute tongue body 2711, the position limit member is arranged at the volute body 2721, and the snapping hole 27162 penetrated through in the front and rear direction is formed in the position limit member. The second snapping hook 27161 may pass through the snapping hole 27162 backwards and snapped with an edge of a side of the snapping hole 27162 away from the volute tongue body 2711. By using the second snapping hook 27161 and the snapping hole 27162 fitted with each other, the fit between the volute tongue body 2711 and the volute body 2721 can become convenient and the number of components (such as the screw 275) can be reduced.

In some embodiments, the volute assembly 27 also includes a motor cage 273. As shown in FIG. 24, the motor cage 273 is arranged at left ends of the first volute 271 and the second volute 272, the motor cage 273 is used for mounting a motor therein, and the motor cage 273 is connected to the first volute 271 and the second volute 272 to ensure the assembling reliability of the motor cage 273.

In some embodiments, as shown in FIG. 24, the motor cage 273 and the first volute 271 are connected by a snap and a screw 275, and the motor cage 273 and the second volute 272 are also connected by a snap and a screw 275. Alternatively, the motor cage 273 is connected to the first volute 271 by a snap and a screw 275, or the motor cage 273 is connected to the second volute 272 by a snap and a screw 275. Compared with the manner in the related art that the assembling is realized only by using the screw, the connection of the motor cage 273 with the first volute 271 and the second volute 272 realized by the snap in conjunction with the screw 275 can reduce the number of screws 275, facilitate the assembling and improve the production efficiency.

In some embodiments, the motor cage 273 may be molded integrally with the first volute 271, and the motor cage 273 is connected to the second volute 272 by the snap and the screw 275. Or, the motor cage 273 is molded integrally with the second volute 272, and the motor cage 273 is connected to the first volute 271 by the snap and the screw 275. In this way, the molding is convenient, the structure is more stable and also the assembling efficiency is improved.

In some embodiments, as shown in FIG. 24, the motor cage 273 includes a first cage body 2731 and a second cage body 2732. The first cage body 2731 and the first volute 271 are connected, for example, being molded integrally or connected by the snap and the screw 275. The second cage body 2732 and the second volute 272 are connected, for example, being molded integrally or connected by the snap and the screw 275. The first cage body 2731 and the second cage body 2732 are connected by the snap and/or the screw 275, and a junction of the first cage body 2731 and the second cage body 2732 is on a same connection surface with the joint of the first volute 271 and the second volute 272. The first volute 271 and the second volute 272 can be connected by connecting the first cage body 2731 with the second cage body 2732. The number of components can be reduced and the assembling is convenient by using the connection through the snap in conjunction with the screw 275.

In some embodiments, as shown in FIG. 24, an upper end of the first cage body 2731 and an upper end of the second cage body 2732 are connected by a second snap 2733, and a lower end of the first cage body 2731 and a lower end of the second cage body 2732 are connected by the screw 275.

The second snap 2733 is arranged at one of the first cage body 2731 and the second cage body 2732, and a fitting hole is formed in one of the first cage body 2731 and the second cage body 2732. For example, two second snaps 2733 are arranged at the upper end of the first cage body 2731 side by side, the fitting hole is formed in the second cage body 2732, and the second snap 2733 is snapped in the fitting hole correspondingly. Each second snap 2733 includes two third snapping hooks facing away from each other towards left and right sides. The two third snapping hooks may be snapped with edges of the fitting hole at left and right sides after passing through the fitting hole simultaneously.

It can be understood that, since the left and right ends of the first extension plate 2712 of the first volute 271 extend beyond the volute tongue body 2711, the left and right ends of the second extension plate 2722 of the second volute 272 extend beyond the volute body 2721, and the motor cage 273 is arranged at the left end of the volute assembly 27 and is located below the first extension plate 2712 and the second extension plate 2722, when the first cage body 2731 and the second cage body 2732 are mounted, or when the motor cage 273 and the first volute 271 and/or the second volute 272 are mounted, it will cause great inconvenience to operation if the screw connection in the related art is still used, i.e., the hand or tool cannot be stretched thereinto for operation due to a space limitation. In the embodiments of the present application, the upper end of the first cage body 2731 and the upper end of the second cage body 2732 is connected by the second snap 2733. When the first cage body 2731 and the second cage body 2732 are connected, the second snap 2733 may pass through the fitting hole and be engaged in the fitting hole after a connection surface of the first cage body 2731 and a connection surface of the second cage body 2732 abut with each other. The assembling is very convenient, the number of screws 275 is reduced and also the operation efficiency is improved.

Figure 25:
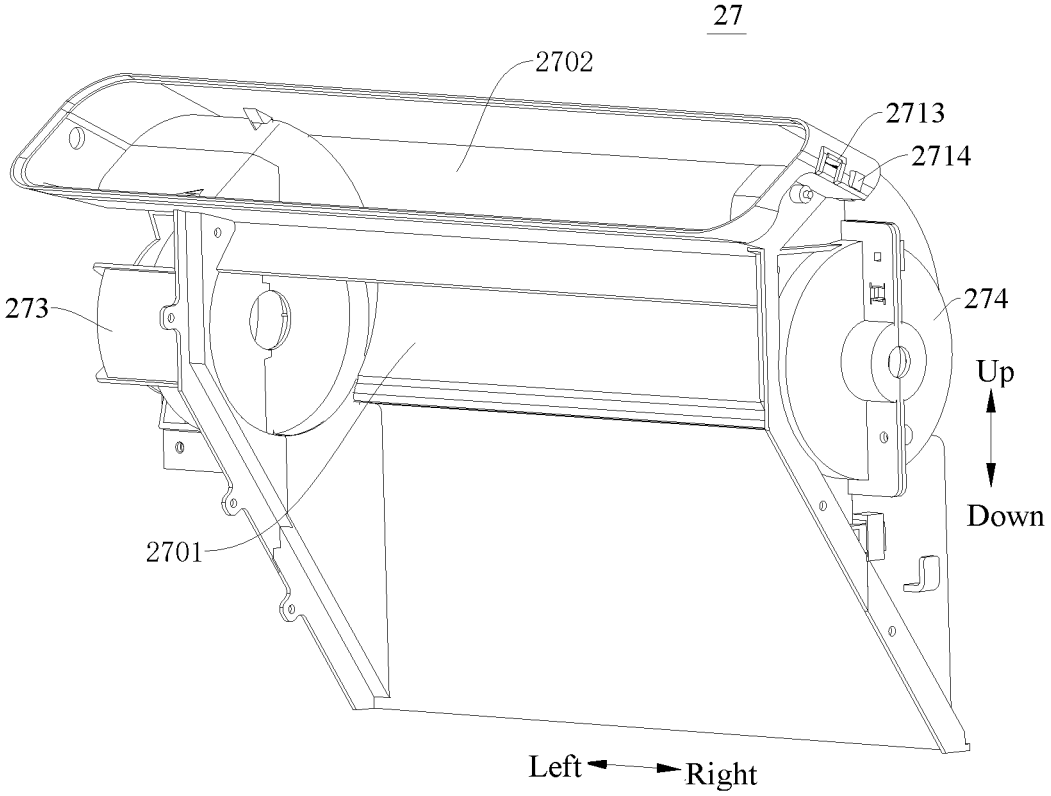
FIG. 25 is a perspective view of the volute assembly shown in FIG. 22 from another angle.
Figure 26:
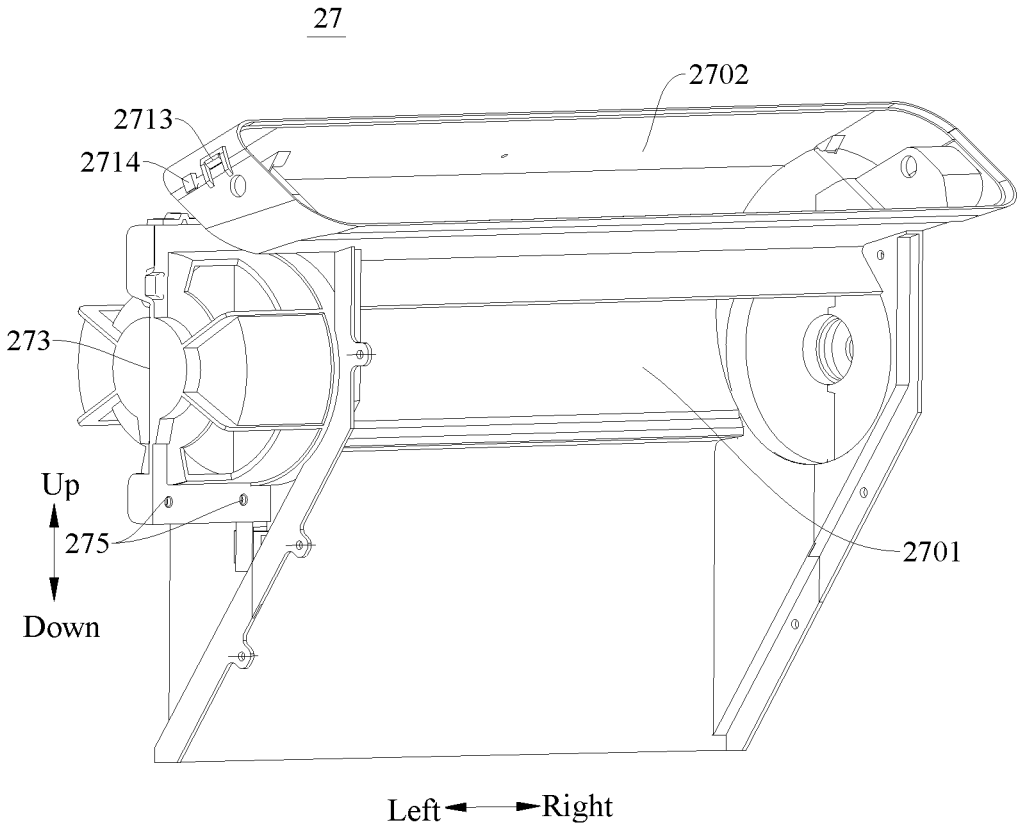
FIG. 26 is a perspective view of the volute assembly shown in FIG. 22 from still another angle.
Figure 27:
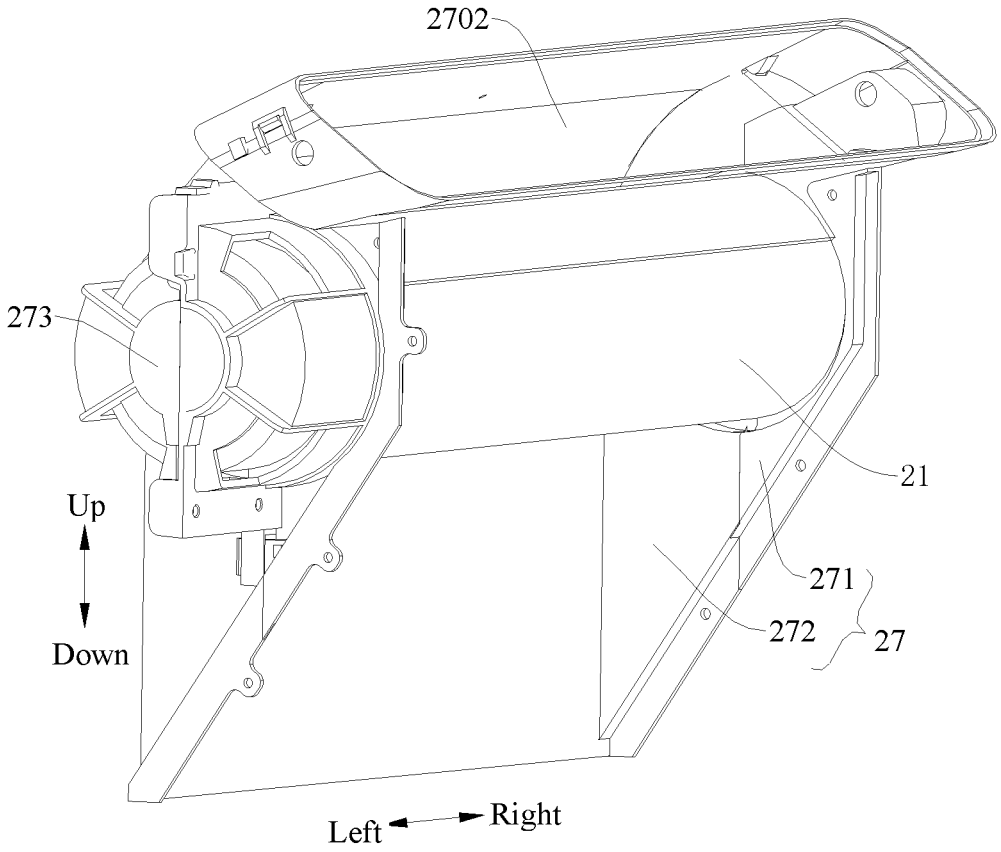
FIG. 27 is a perspective assembly view of the volute assembly shown in FIG. 22 and a wind wheel.
Figure 28:
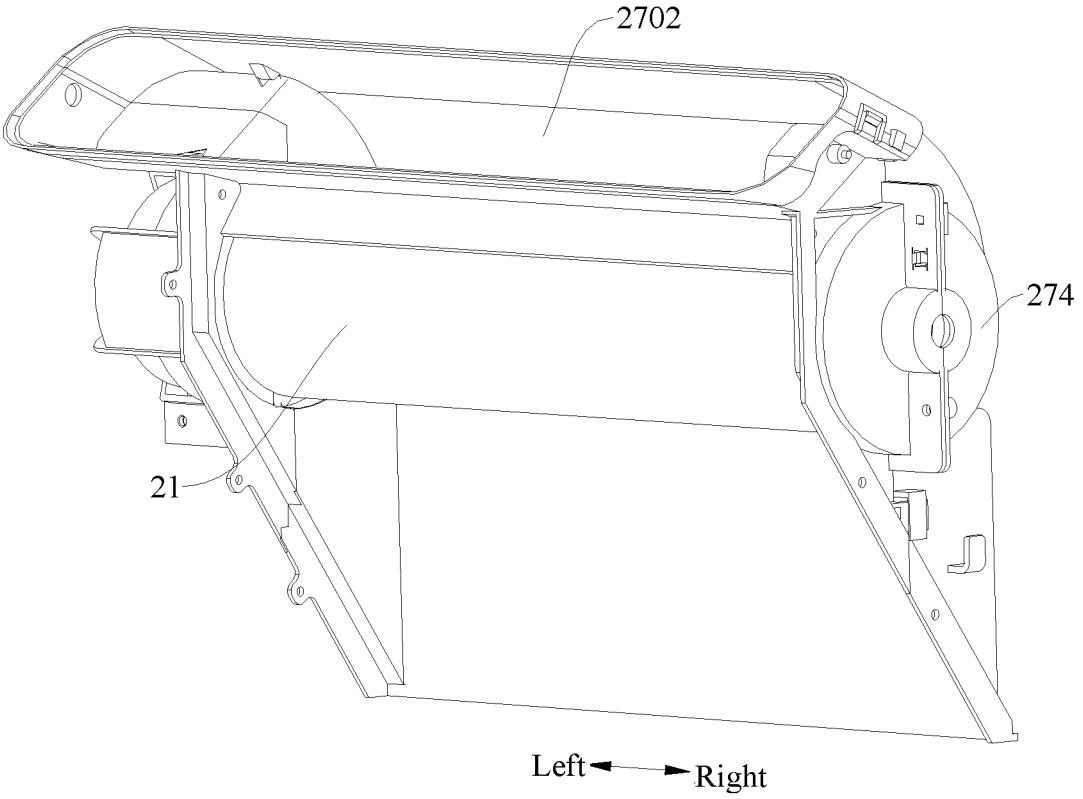
FIG. 28 is a perspective assembly view of the volute assembly and the wind wheel shown in FIG. 27 from another angle.

In some embodiments, as shown in FIG. 23, the volute assembly 27 also includes a bearing cover 274, and the bearing cover 274 is used to mounting a bearing therein. As shown in FIGS. 25 and 28, the bearing cover 274 is located at right ends of the first volute 271 and the second volute 272, and the bearing cover 274 is connected to the first volute 271 and the second volute 272 to ensure the reliability of the connection.

In some embodiments, as shown in FIG. 23, the bearing cover 274 includes a first cover body 2741 and a second cover body 2742, the first cover body 2741 and the first volute 271 are connected, and the second cover body 2742 and the second volute 272 are connected. The first cover body 2741 and the second cover body 2742 may be connected only by the snap, the first cover body 2741 and the second cover body 2742 may also be connected only by the screw 275, and the first cover body 2741 and the second cover body 2742 may also be connected by the snap in conjunction with the screw 275, so as to meet the application requirements of different actual situations.

In some embodiments, as shown in FIG. 23, an upper end of the first cover body 2741 and an upper end of the second cover body 2742 are connected by the snap, which can avoid the inconvenient operation caused by the space limitation when the screw 275 is used for connection, and a lower end of the first cover body 2741 and a lower end of the second cover body 2742 are connected by the screw 275. In this way, the connection operation of the first cover body 2741 and the second cover body 2742 is convenient, and the connection reliability can also be ensured. The production efficiency is improved, and also the number of screws 275 is reduced.

Figure 29:
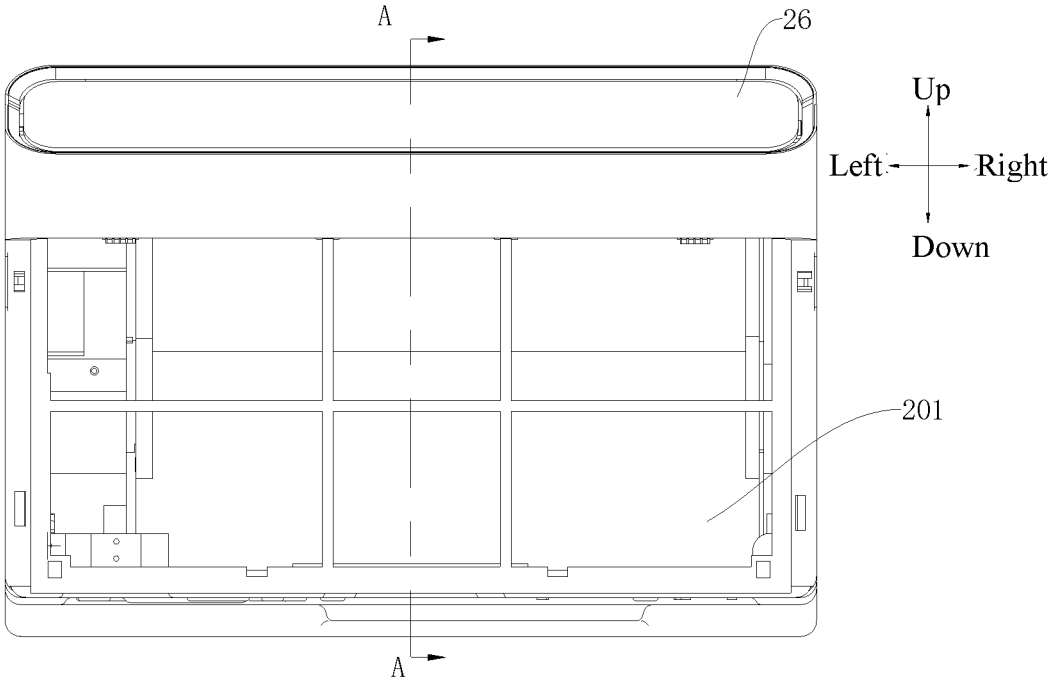
FIG. 29 is a partial schematic diagram of a window air conditioner according to an embodiment of the present application.
Figure 30:
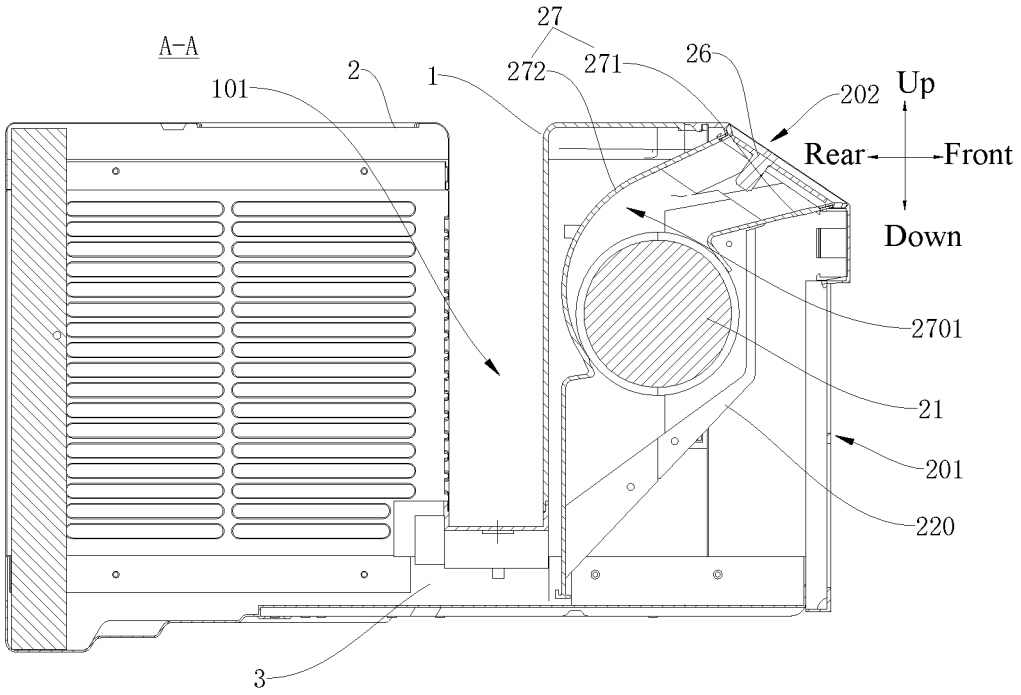
FIG. 30 is a sectional view along a line A-A in FIG. 29.

In some embodiments of the present application, as shown in FIGS. 29-30, the window air conditioner 100 includes an air channel assembly 2A, and the air channel assembly 2A includes the volute assembly 27 and an air guide plate 26. It is necessary to note that the volute assembly 27 of this embodiment may be the same as that of any of the above embodiments, or may be different from that of any of the above embodiments.

As shown in FIGS. 29-30, the air channel 2701 is formed in the volute assembly 27, and the air guide plate 26 is rotatably arranged at the air outlet 2702 of the air channel 2701. The airflow flowing into the air channel 2701 may blow to an indoor environment under an air guide action of the air guide plate 26, so as to realize the air output at different angles.

Therefore, by rotatably arranging the air guide plate 26 at the air outlet 2702 of the air channel 2701, the air output area of the air outlet can be adjusted easily when the air guide plate 26 rotates. It is conducive to improving the air supply range of the window air conditioner 100 when the air guide plate 26 opens the air outlet 2702 of air channel 2701 to a large extent. It is conducive to increasing the air output pressure when the air guide plate 26 opens the air outlet to a small extent, so as to realize a long-distance air supply and provide a good air guide effect. In addition, during the mounting of the window air conditioner 100, the air guide plate 26 and the volute assembly 27 can be assembled, so that the air channel assembly 2A can be then mounted as a whole module in an indoor casing 20 of the window air conditioner 100, which is conducive to further improving the assembling efficiency of the window air conditioner 100.

In some embodiments of the present application, as shown in FIG. 30, the indoor assembly 1 has an air input region 201 and an air output region 202, and the air channel assembly 2A is arranged in the indoor assembly 1 and is located between the air input region 201 and the air output region 202. The indoor fan 21 is arranged in the air channel 2701, and the indoor heat exchanger 220 is arranged in the indoor assembly 1 and located between the volute assembly 27 and the air input region 201.

Figure 34:
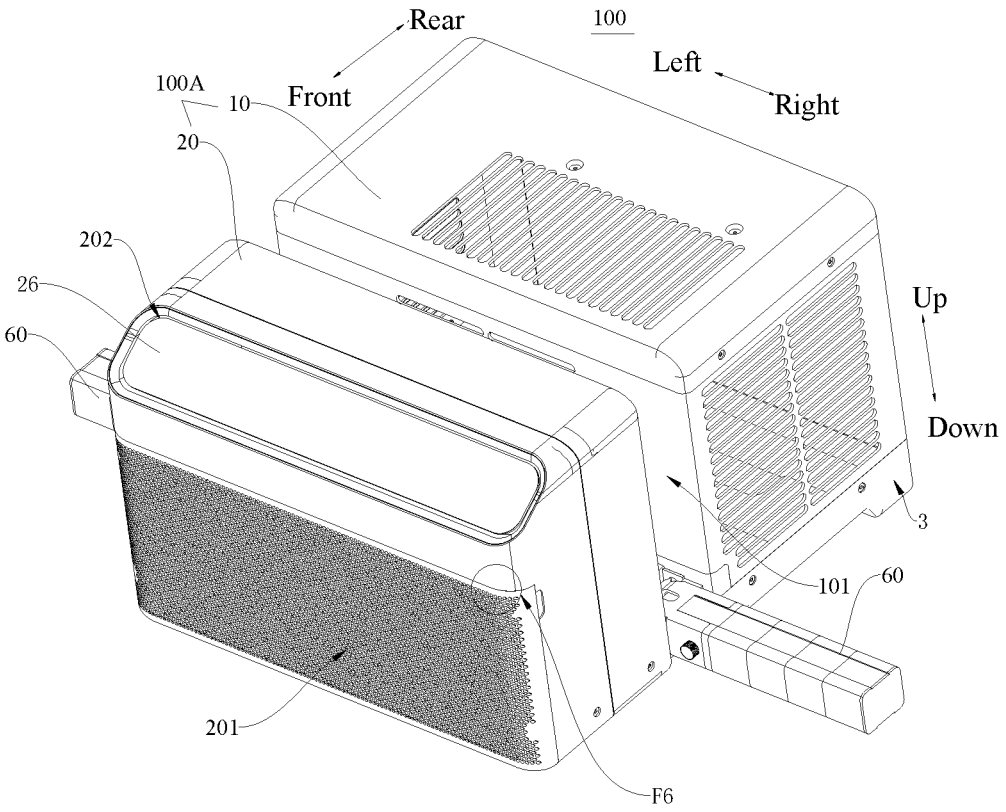
FIG. 34 is a perspective view of a window air conditioner according to an embodiment of the present application.
Figure 35:
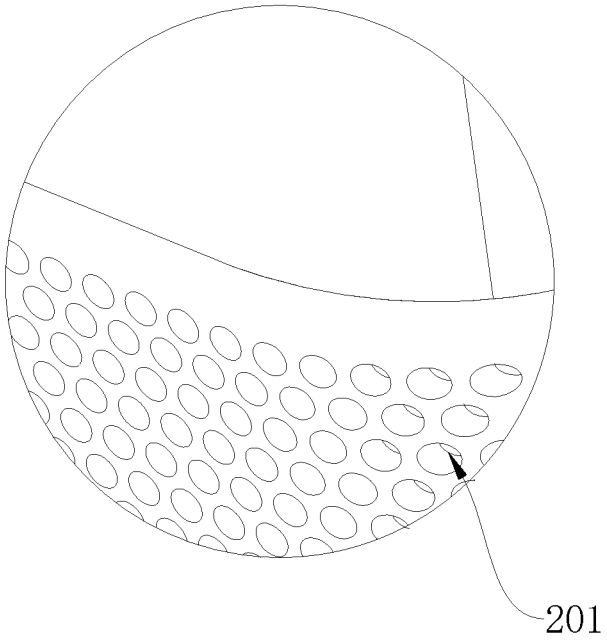
FIG. 35 is an enlarged view of a portion circled at F6 shown in FIG. 34.

For example, as shown in FIGS. 34 and 35, the air input region 201 is arranged at a front side wall of the indoor assembly 1, and the air input region 201 is formed by a plurality of mesh holes. From bottom to top, the air output region 202 extends rearwards obliquely from the front side wall of the indoor assembly 1 to a top wall of the indoor assembly 1. The indoor airflow enters the indoor assembly 1 through the air input region 201 under the drive of the indoor fan 21 and exchanges heat with the indoor heat exchanger 220 located in the indoor assembly 1. The airflow after heat exchange enters the air channel 2701 of the volute assembly 27. After flowing out from the air channel 2701, the airflow is discharged through the air output region 202 to the indoor environment to adjust the temperature of the indoor environment.

Figure 31:
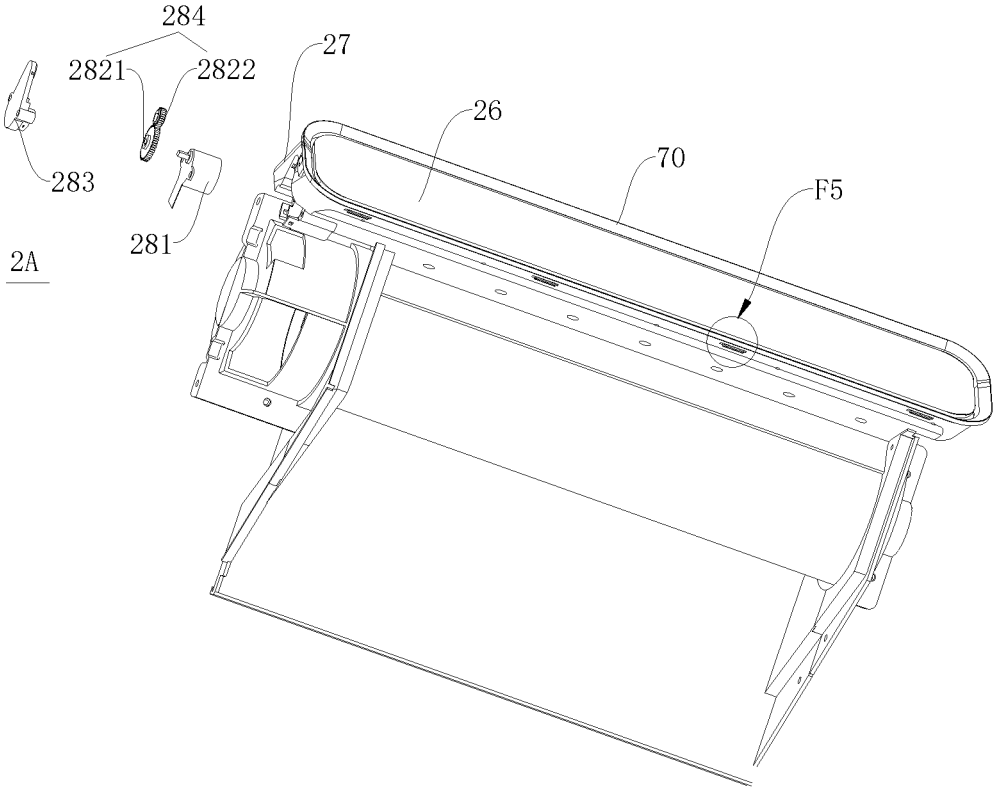
FIG. 31 is an assembly view of an air channel assembly and a decorative strip according to an embodiment of the present application.

In some embodiments of the present application, as shown in FIG. 31, the air channel assembly 2A also includes a drive motor 281 (such as a stepping motor). The drive motor 281 is arranged at the volute assembly 27 (for example, the first volute 271 described above) for driving the air guide plate 26 to rotate. Therefore, the air guide plate 26 is driven to rotate by the drive motor 281, so that it is conducive to controlling the rotation angle, the rotation direction and the rotation frequency of the air guide plate 26 according to actual needs of the user, and thus the adjustment becomes convenient and more intelligent. Of course, it can be understood that in other embodiments, the drive motor 281 may also be omitted, and a force generated when the airflow flows thereby is used to push the air guide plate 26 to rotate to a predetermined angle when the airflow flows through the air channel 2701.

In some embodiments of the present application, an accommodating groove is formed in the volute assembly 27 (for example, the first volute 271 described above), and the drive motor 281 is mounted to the accommodating groove. For example, the accommodating groove recessed towards an interior of the air channel 2701 is formed in an outer surface of the volute assembly 27, and the drive motor 281 is mounted in the accommodating groove. A motor shaft of the drive motor 281 penetrates through a bottom wall (an inner wall opposite to an opening) of the accommodating groove and into the air channel 2701 to be connected to the air guide plate 26 located at the air outlet 2702 of the air channel 2701, and then drives the air guide plate 26 to rotate.

In some embodiments of the present application, a vent hole communicated with the air channel 2701 is formed in the bottom wall of the accommodating groove, so that a part of the airflow can flow to the drive motor 281 through the vent hole when the airflow flows through the air channel 2701, thus dissipating heat in the drive motor 281 by the airflow, so as to improve the working reliability of the drive motor 281.

In some embodiments of the present application, a plurality of vent holes are provided, the plurality of vent holes are spaced apart from each other along a circumferential direction of the drive motor 281, and each vent hole extends into a strip shape. Therefore, the heat dissipation effect of the drive motor 281 can be further improved.

In some embodiments of the present application, the air channel assembly 2A also includes a transmission member 282, the transmission member 282 is connected between the motor shaft of the drive motor 281 and the air guide plate 26, and the drive motor 281 drives the transmission member 282 to rotate, for driving the air guide member to rotate. For example, the transmission member 282 is a chain, and the chain surrounds the motor shaft of the drive motor 281 and a transmission shaft at an end of the air guide plate 26 and is fitted with the motor shaft and the transmission shaft. Therefore, when the motor shaft of the drive motor 281 rotates, the rotation of the motor shaft drives the chain to rotate synchronously, and the rotation of the chain drives the transmission shaft to rotate synchronously, thus realizing the rotation of the air guide plate 26 driven by the drive motor 281.

Figure 33:
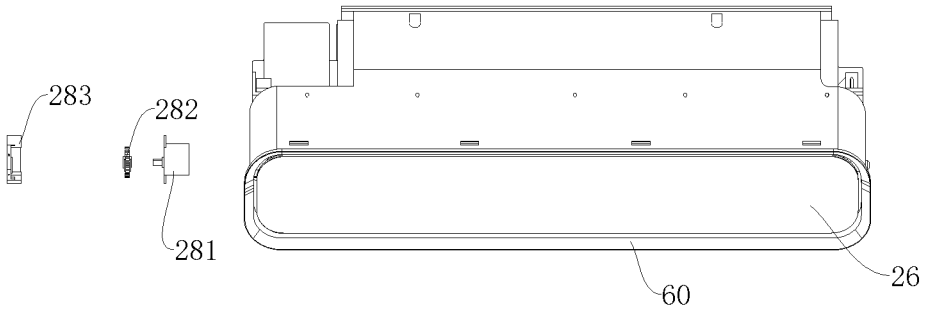
FIG. 33 is a front projection view of the air channel assembly and the decorative strip shown in FIG. 31.

In some embodiments of the present application, referring to FIG. 33, the drive motor 281 and the air guide plate 26 are located at the same side of the transmission member 282. For example, a plane where the transmission member 282 is located is formed as a plane m, the plane m is perpendicular to a rotation center line of the transmission member 282, and the drive motor 281 and the air guide plate 26 are located at the same side of the plane m. That is, the drive motor 281 and the air guide plate 26 are not located at two axial sides of the transmission member 282 respectively, but are located at a same axial side of the transmission member 282.

In the related art, the drive motor and the air guide plate are generally located at two sides of the transmission member. In order to realize the mounting of the drive motor, a fixing member for fixing the drive motor shall be additionally arranged at a mounting member (such as the volute assembly described above) where the air guide plate is located, which leads to the need for additional fixing members, so that a width of the whole volute assembly (the width refers to a dimension of the volute assembly along an axial direction of the motor) is large, and a material cost is high. However, in this embodiment, the drive motor 281 is directly fixed to the volute assembly 27, thus eliminating the additional fixing member, so that an overall width of the volute assembly 27 is reduced and the manufacturing cost is saved.

Therefore, by locating the drive motor 281 and the air guide plate 26 on the same side of the transmission member 282, it is conducive to reducing a volume of the volute assembly 27, saving the space and reducing the material cost.

In some embodiments of the present application, the transmission member 282 includes a first gear 2821 and a second gear 2822, the first gear 2821 is meshed with the second gear 2822, the first gear 2821 is connected to the motor shaft, and the second gear 2822 is connected to the air guide plate 26.

For example, as shown in FIG. 31, the first gear 2821 is externally meshed with the second gear 2822, the transmission shaft is arranged at the end of the air guide plate 26, a cross section of the transmission shaft is non-circular, and a cross section of the motor shaft of the drive motor 281 is non-circular. A fitting hole into which the motor shaft extends is formed in the first gear 2821, and a positioning hole into which the transmission shaft extends is formed in the second gear 2822. The transmission shaft of the air guide plate 26 extends out of the volute assembly 27 through a side wall of the volute assembly 27 to be fitted with the second gear 2822. When the drive motor 281 works, the motor shaft rotates and drives the first gear 2821 to rotate, the rotation of the first gear 2821 drives the second gear 2822 to rotate in a driven manner, and the rotation of the second gear 2822 drives the air guide plate 26 to rotate. In some embodiments of the present application, the cross section of the transmission shaft is formed to have a semicircle shape, and the cross section of the motor shaft is formed to have an obround shape. Therefore, the structure is simple and easy to process.

In some embodiments of the present application, as shown in FIG. 31, the air channel assembly 2A also includes a fitting cover 283, which is suitable for covering the transmission member 282 and is fixed to the volute assembly 27. For example, the accommodating groove is formed in the above first volute 271, and the drive motor 281 is mounted in the accommodating groove. The drive motor 281 is connected to the air guide plate 26 through the first gear 2821 and the second gear 2822 described above to drive the air guide plate 26 to rotate. The fitting cover 283 is used to cover the first gear 2821 and the second gear 2822 and is fitted with the first volute 271. Thus, it is beneficial to improving the working reliability of the air channel assembly 2A.

In some embodiments of the present application, there is one air guide plate 26, and the one air guide plate 26 is arranged at the air outlet 2702 of the air channel 2701. The air output region can be opened or closed by the rotation of the one air guide plate 26, and the airflow guide effect can also be realized. In some other embodiments, a plurality of air guide plates 26 may also be provided, and the plurality of air guide plates 26 are spaced apart and linked. In the window air conditioner 100 according to the embodiments of the present application, by the arrangement of the above air channel assembly 2A, the air output area of the air outlet 2702 can be adjusted easily when the air guide plate 26 rotates. It is conducive to improving the air supply range of the window air conditioner 100 when the air guide plate 26 opens the air outlet 2702 of the air channel 2701 to a large extent. It is conducive to increasing the air outlet pressure when the air guide plate 26 opens the air outlet to a small extent, so as to realize a long-distance air supply and provide a good air guide effect. In addition, during the mounting of the window air conditioner 100, the air guide plate 26 and the volute assembly 27 may be assembled, so that the air channel assembly 2A may be then mounted as a whole module in an air conditioner housing 100A of the window air conditioner 100, which is conducive to further improving the assembling efficiency of the window air conditioner 100.

Figure 32:
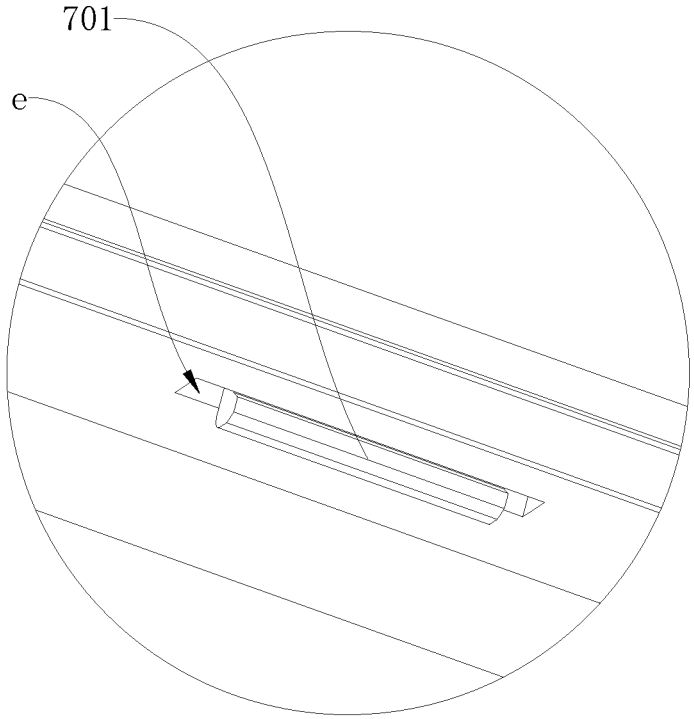
FIG. 32 is an enlarged view of a portion F5 shown in FIG. 31.

In some embodiments of the present application, as shown in FIGS. 31 and 32, the window air conditioner 100 also includes an annular decorative strip 70, which is located in the air output region. An inner end of the decorative strip 70 is connected to an end face of the air outlet 2702 of the air channel 2701, and along an air output direction, an outer end of the decorative strip 70 extends obliquely in a direction running away from a center of the air output region. Therefore, when the user faces the air output region directly, the decorative strip 70 at the air output region can be seen intuitively, which is conducive to improving the decorative effect of the decorative strip 70 and giving the user a good visual experience.

In some embodiments of the present application, an outer end face of the decorative strip 70 is flush with an outer end face of the air output region. Therefore, it is conducive to further optimizing the appearance of the window air conditioner 100 and improving the visual experience of the user.

In some embodiments of the present application, as shown in FIGS. 31 and 32, the decorative strip 70 is detachably connected to the volute assembly 27. Therefore, it is not only convenient to disassemble and assemble the decorative strip 70 from/with the volute assembly 27, but also can facilitate the replacement of the decorative strip 70 if the decorative strip 70 is damaged accidentally during the subsequent use of the window air conditioner 100. Compared with the integral configuration of the decorative strip 70 and the volute assembly 27, it is not necessary to replace the decorative strip together with the volute assembly 27, which is conducive to reducing the maintenance cost.

For example, in the specific example shown in FIGS. 31 and 32, a third snap 701 is arranged at the decorative strip 70, and a snapping groove e fitted with the third snap 701 is arranged in the volute assembly 27. For example, referring to FIG. 32, the decorative strip 70 is an injection molded member, and the decorative strip 70 having the third snap 701 is integrally injection-molded through an injection molding process. The snapping groove e fitted with the third snap 701 is formed in the volute assembly 27. With the third snap 701 of the decorative strip 70 being snapped to the snapping groove e, the detachable connection between the decorative strip 70 and the volute assembly 27 is realized. It is not only convenient to disassembly and assembly the decorative strip 70 from/with the volute assembly 27, but also can facilitate the replacement of the decorative strip 70 if the decorative strip 70 is damaged accidentally during the subsequent use of the window air conditioner 100. Compared with the integral configuration of the decorative strip 70 and the volute assembly 27, it is not necessary to replace the decorative strip together with the volute assembly 27, which is conducive to reducing the maintenance cost.

Figure 36:
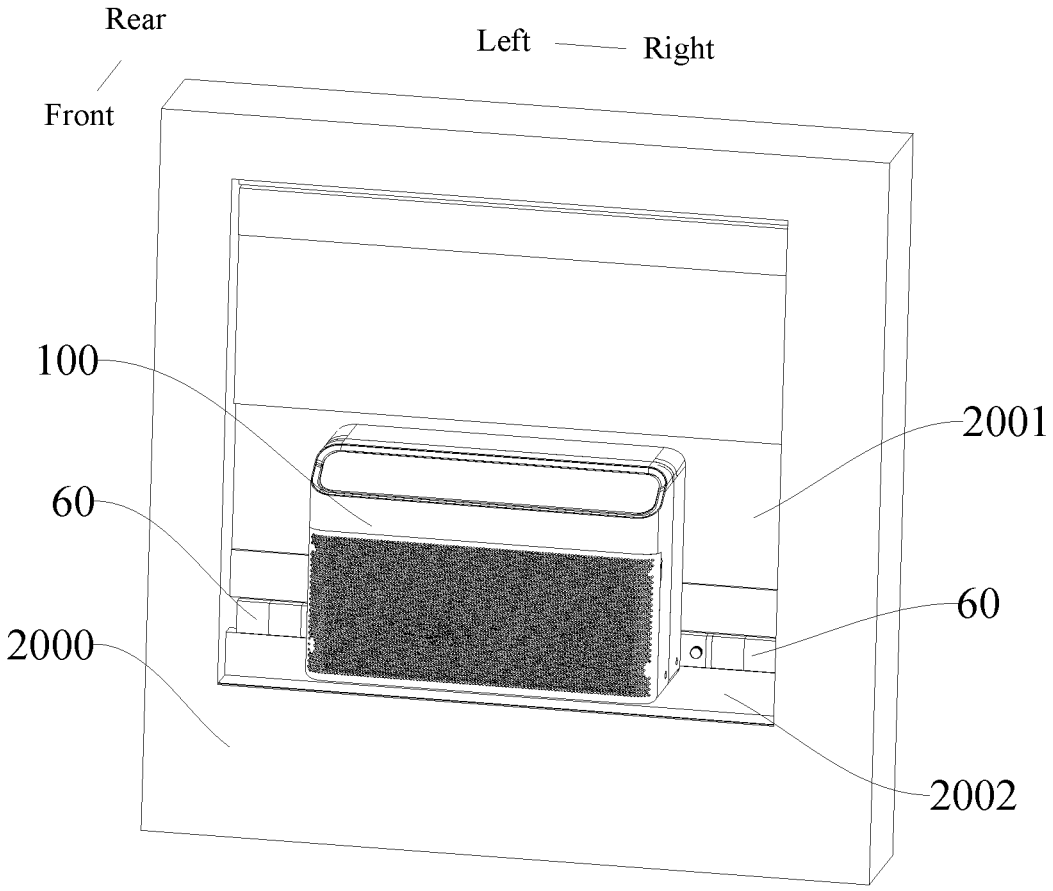
FIG. 36 is a schematic mounting view of the window air conditioner shown in FIG. 34.

According to some embodiments of the present application, referring to FIGS. 34 and 36, the window air conditioner 100 also includes the chassis 3, and the outdoor assembly 1 and the indoor assembly 2 are mounted at the chassis 3 and spaced apart from each other. A receiving groove 101 is formed by the outdoor assembly 1, the indoor assembly 2 and the chassis 3, and the receiving groove 101 is located between the outdoor assembly 1 and the indoor assembly 2. In other words, the receiving groove 101 is formed in an outer circumferential wall of the air conditioner housing 100A of the window air conditioner 100, and the air conditioner housing 100A is separated into the indoor assembly 1 and the outdoor assembly 2 through the receiving groove 101. For example, the receiving groove 101 recessed downwards is formed in a top wall of the air conditioner housing 100A, and the receiving groove 101 is open on both left and right sides. The air conditioner housing 100A is separated into the indoor assembly 1 and the outdoor assembly 2 through the receiving groove 101 in the front and rear direction.

The window air conditioner 100 is suitable to be supported in a window 2001 of a wall 2000, and a slidable (up and down or left and right) sash 2002 is arranged in the window 2001. At least a part of the sash 2002 is suitable for (downwards or horizontally) extending into the receiving groove 101. For example, only a part of the sash 2002 may extend into the receiving groove 101, or the entire sash 2002 may also extend into the receiving groove 101.

Therefore, it is not only convenient to mount the window air conditioner 100 into window 2001, so as to improve the mounting reliability and stability of the window air conditioner 100, but also convenient for the window air conditioner 100 and the sash 2002 to be fitted with each other. In addition, the sash 2002 may also be used to prevent the noise from being transmitted to the indoor from the outdoor assembly 1, so that the noise of the window air conditioner 100 when being used is less. In addition, the sash 2002 may also be used to seal the window 2001, so as to avoid the indoor airflow after heat exchange from being discharged through the window 2001 to the outdoor when the window air conditioner 100 works.

In some embodiments of the present application, as shown in FIGS. 1 and 2, the outdoor assembly 1 also includes an outdoor casing 10, and the indoor assembly 2 also includes an indoor casing 20 and an indoor fan 21. The volute assembly 27 and the indoor fan 21 are arranged in the indoor casing 20, and the indoor fan 21 is arranged in the air channel 2701 in the volute assembly 27. The indoor fan 21 is used to drive the air to flow to the air outlet 2702. In the front and rear direction as shown in FIG. 28, bounded by the receiving groove 101, the indoor casing 20 at a front end is arranged indoors (i.e., a front side is equivalent to an indoor side), the outdoor casing 10 at a rear end is arranged outdoors (i.e., a rear side is equivalent to an outdoor side), and the air outlet 2702 of the volute assembly 27 is arranged atwards the front side.

According to some embodiments of the present application, the air conditioner housing 100A also includes an intermediate partition plate 5, which is fixed at the chassis 3 and is located in the receiving groove 101. Front and rear ends of the intermediate partition plate 5 are fitted with the outdoor casing 10 and the indoor casing 20, respectively. In this way, it is convenient for a lower surface of the sash 2002 to abut against the intermediate partition plate 5, which facilitates the wiring and the water drainage of the window air conditioner 100, and improves the working reliability of the window air conditioner 100.

According to some embodiments of the present application, referring to FIGS. 34 and 36, the window air conditioner 100 also includes a sealing assembly 60, which is suitable for contacting with the sash 2002 and an inner wall of the window 2001, respectively. In this way, the sealing assembly 60 can seal the sash 2002 and the inner wall of the window 2001 when the window air conditioner 100 is supported in the window 2001 of the wall 2000, so as to ensure the airtightness of the indoor environment.

According to some embodiments of the present application, a sealing sponge is arranged at a top wall of the sealing assembly 60, and the sash 2002 abuts against the sealing sponge. In this way, it can not only avoid a direct contact between the sash 2002 and the sealing assembly 60, so as to reduce the contact wear between the sash 2002 and the sealing assembly 60, but also improve the sealing effect between the sash 2002 and the sealing assembly 60.

Figure 37:
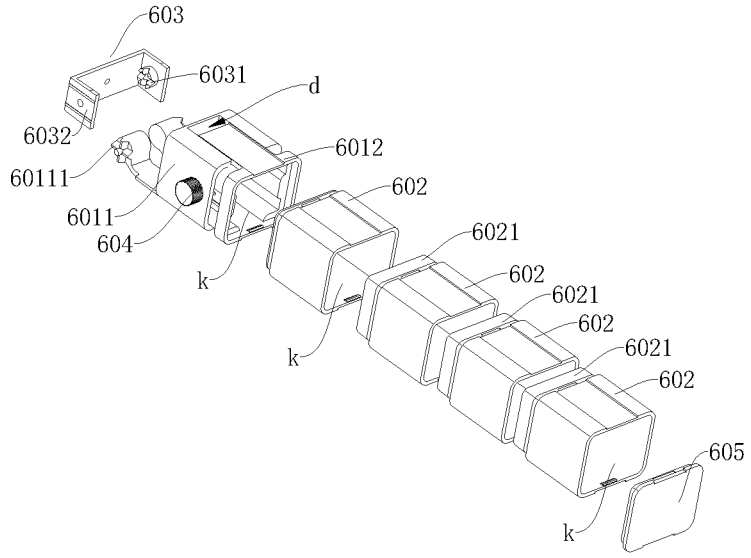
FIG. 37 is an exploded schematic diagram of a sealing assembly according to an embodiment of the present application.
Figure 38:
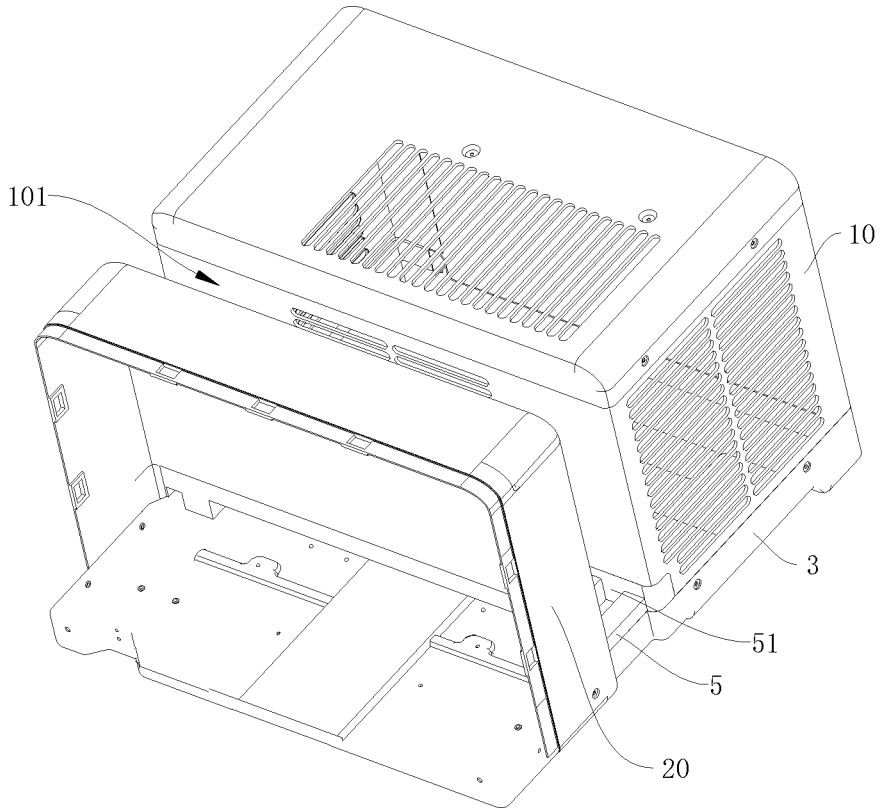
FIG. 38 is a partial schematic diagram of a window air conditioner according to an embodiment of the present application.
Figure 39:
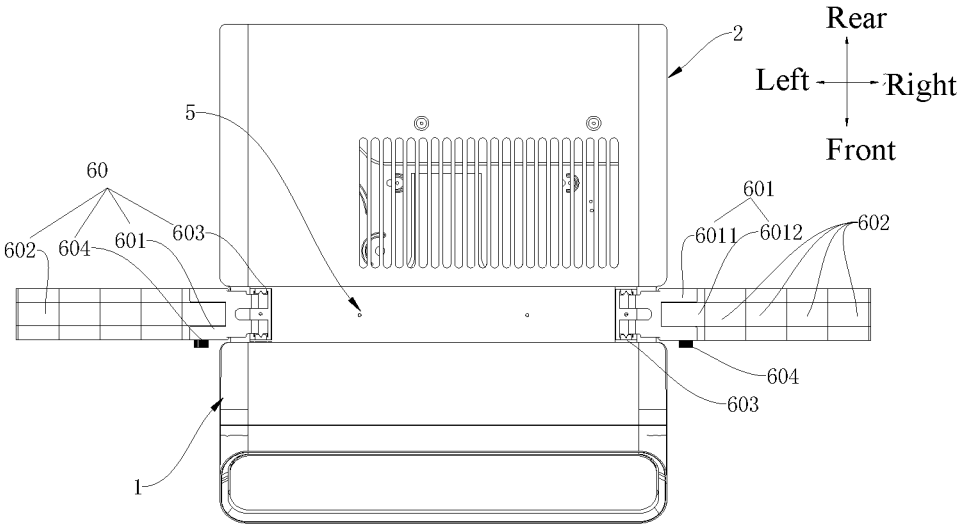
FIG. 39 is a top view of a window air conditioner according to an embodiment of the present application.

In some embodiments of the present application, as shown in FIGS. 37-39, the sealing assembly 60 includes a first connection component 601 with a variable length and a plurality of second connection components 602. The first connection component 601 includes a fixation member 6011 and a sliding block 6012, at least a part of the fixation member 6011 is arranged in the receiving groove 101, and the sliding block 6012 is slidably fitted with the fixation member 6011. Any one of the second connection components 602 is detachably connected to the sliding block 6012, and any two of the second connection components 602 are detachably connected for adjusting a length of the sealing assembly 60. Therefore, since the sealing assembly 60 includes the first connection component 601, and the first connection component 601 includes the fixation member 6011 and the sliding block 6012, the sealing assembly 60 can be mounted to the window air conditioner by using the fixation member 6011, so as to facilitate the arrangement of the sealing assembly 60, and avoid the loss of the sealing assembly 60, and also a length of the first connection component 601 can be adjusted through the slidable fit between the sliding block 6012 and the fixation member 6011, so that a sealing length of the sealing assembly 60 can be adjusted, and thus the sealing assembly 60 can seal the sash 2002 of different sizes, which helps to improve the sealing effect of the sealing assembly 60, and to enhance the service range of the sealing assembly 60. Thus, the application scope of the window air conditioner 100 is improved, and the function and applicability of the window air conditioner 100 is enhanced.

In addition, the plurality of second connection components 602 are provided, any one of the second connection components 602 is detachably connected to the sliding block 6012 and any two of the second connection components 602 are detachably connected with each other. In this way, it is convenient to improve the structural flexibility of the sealing assembly 60. The length of the sealing assembly 60 can be adjusted by connecting different numbers of the second connection components 602, which helps to improve the range of the sealing length of the sealing assembly 60, and allows the sealing assembly 60 to be adapted with the sash 2002 of different sizes. Further, the sealing reliability and stability of the sealing assembly 60 is improved, and the use range of the sealing assembly 60 is enhanced.

Therefore, the sealing assembly 60 of the window air conditioner 100 according to the embodiments of the present application has the advantages of a variable sealing length and a convenient use, etc.

In some embodiments of the present application, as shown in FIGS. 37 and 39, the sliding block 6012 and the second connection components 602 form a sealing fitting member, the sealing fitting member and the fixation member 6011 are connected with each other, and the sealing fitting member may rotate to extend out of the receiving groove 101 to abut against the inner wall of the window 2001. In this way, the sealing length of the sealing assembly 60 can be adjusted by adjusting a length of the sealing fitting member.

In some embodiments of the present application, as shown in FIGS. 37 and 39, the sealing assembly 60 also includes a rotation support 603, the rotation support 603 is fixed at the air conditioner housing 100A, and the fixation member 6011 is rotatably arranged at the rotation support 603 so that the sealing assembly 60 can rotate to be received in the receiving groove 101. In this way, it is not only convenient for the mounting and arrangement of the fixation member 6011, but also convenient to realize the rotation of the fixation member 6011 relative to the rotation support 603, so as to facilitate the storage of the sealing assembly 60, thus reducing the space occupied by the sealing assembly 60.

In some embodiments of the present application, a pivot shaft is arranged at the fixation member 6011, a pivot hole is formed in the rotation support 603, and the pivot shaft is rotatably fitted in the pivot hole. In this way, the pivot shaft and the pivot hole 3 can be fitted with each other, which realizes the smooth rotation of the fixation member 6011 and improves the rotation reliability of the fixation member 6011.

As shown in FIG. 37, in some embodiments of the present application, the sealing assembly 60 also includes an angle positioning assembly, and the angle positioning assembly is fitted with the rotation support 603 and the fixation member 6011 respectively, so as to position the fixation member 6011 at a current angle when the fixation member 6011 rotates to a set angle. In this way, the fixation member 6011 is positioned at a specific angle. For example, the fixation member 6011 is positioned to have an included angle of 90°, 45° or 30° with the horizontal direction. It is convenient for the user to position the rotation angle of the fixation member 6011 according to the requirements, thus improving the use performance of the sealing assembly 60.

In some embodiments of the present application, as shown in FIG. 37, the angle positioning assembly includes a positioning projection 60111 and a plurality of positioning grooves 6031, the positioning projection 60111 is arranged at one of the rotation support 603 and the fixation member 6011, and the plurality of positioning grooves 6031 are arranged in the other one of the rotation support 603 and the fixation member 6011.

In some embodiments of the present application, the positioning projection 60111 is arranged at the fixation member 6011 and the plurality of positioning grooves 6031 are arranged in the rotation support 603. For example, the plurality of positioning grooves 6031 are arranged in a ring. When the rotation support 603 rotates, the positioning projection 60111 may be fitted with the plurality of positioning grooves 6031 in a switchable manner. When the positioning projection 60111 is fitted with one of the positioning grooves 6031, the fixation member 6011 is positioned. In this way, the rotation angle of the fixation member 6011 can be positioned by using the positioning projection 60111 and the positioning groove 6031, which helps to improve the positioning reliability and stability of the fixation member 6011.

In some embodiments of the present application, a plurality of positioning projections 60111 are provided, the plurality of positioning projections 60111 are arranged in a ring, and the plurality of positioning projections 60111 are fitted with the plurality of positioning grooves 6031 in one-to-one correspondence. In this way, a force applied to the angle positioning assembly can be more balanced, which helps to improve the structural strength of the angle positioning assembly, and to improve the positioning reliability and accuracy of the angle positioning assembly.

As shown in FIG. 37, in some embodiments of the present application, the rotation support 603 includes fitting plates 6032 arranged opposite to each other, each fitting plate 6032 is provided a projection portion on an end face facing the other fitting plate 6032, and each projection portion is provided with the pivot hole and the plurality of positioning grooves 6031. In this way, it is convenient for the processing and arrangement of the pivot hole and the positioning groove 6031, and convenient to realize the rotation fit between the rotation support 603 and the fixation member 6011.

In some embodiments of the present application, the fixation member 6011 includes two fitting projections spaced apart from each other, and each fitting projection is rotatably fitted with the rotation support 603. In this way, it is convenient for the arrangement of the pivot shaft and the positioning projection 60111, for the fit of the fixation member 6011 and the rotation support 603, and for the rotation of the fixation member 6011 relative to the rotation support 603.

In some embodiments of the present application, the sealing assembly 60 also includes a sliding positioning assembly 604, which is arranged at the fixation member 6011 and fitted with the sliding block 6012, so as to position the sliding block 6012 in a current position. In this way, the sliding block 6012 can be positioned by using the sliding positioning assembly 604, and it is convenient to keep the sealing assembly 60 at a specific sealing length, to improve the structural stability of the sealing assembly 60, and to realize the reliable sealing of the sealing assembly 60.

In some embodiments of the present application, a sliding cavity d is arranged in the fixation member 6011, and at least a part of the sliding block 6012 extends into the sliding cavity d. In this way, it is convenient for the fit arrangement of the fixation member 6011 and the sliding block 6012, and convenient for the sliding of the sliding block 6012 relative to the fixation member 6011.

In some embodiments of the present application, the sliding positioning assembly 604 is a rotating member, the rotating member rotatably penetrates through the fixation member 6011 and is fitted with the fixation member 6011 through a thread. The rotating member rotates to adjust a length of a part of the rotating member extending into the sliding cavity d, and the rotating member may abut against the sliding block 6012 to position the sliding block 6012. In this way, the user can control whether the sliding block 6012 can slide by rotating the rotating member, which further facilitates the user to adjust a length of the sliding block 6012 according to the needs.

In some embodiments of the present application, a sliding bump is arranged at an inner wall of the sliding cavity d, and a sliding groove fitted with the sliding bump is arranged in an outer wall of the sliding block 6012. In this way, on one hand, the sliding of the sliding block 6012 can be positioned and guided by using the sliding bump and the sliding groove, which allows the sliding of the sliding block 6012 to be smoother, and on the other hand, the structural strength of the sealing assembly 60 is improved, and the structural reliability and stability of the sealing assembly 60 is further enhanced.

In some embodiments of the present application, each second connection component 602 includes an insertion member 6021, each second connection component 602 and the sliding block 6012 have an insertion cavity k, and each insertion member 6021 is fitted with the insertion cavity k in a pluggable manner. In this way, it is convenient for the connection of adjacent second connection components 602, for the realization of the assembling and molding of the plurality of second connection components 602, and further for the change of the sealing length of the sealing assembly 60.

In some embodiments of the present application, as shown in FIG. 37, the sealing assembly 60 also includes a sealing end cover 605, which is used to seal an open end of the insertion cavity k farthest from the fixation member 6011. In this way, it is not only convenient to seal the insertion cavity k farthest from the fixation member 6011, so as to improve the airtightness of the second connection component 602, but also allows the plurality of second connection components 602 to have the same structure, so as to facilitate the processing and manufacturing of the second connection components 602, and to improve the interchangeability of the second connection components 602.

In some embodiments of the present application, tags may also be added to the plurality of second connection components 602 respectively, so that the plurality of second connection components 602 have a certain arrangement sequence.

In some embodiments of the present application, the first connection component 601 and each second connection component 602 have a groove for accommodating the sealing sponge, which facilitates the arrangement of the sealing sponge and further helps to improve the sealing performance of the sealing sponge.

In some embodiments of the present application, the second connection component is a member of material such as plastic, sheet metal, rubber, silica gel or foam. In addition, the sealing assembly 60 may be a member of material such as plastic, sheet metal, rubber, silica gel or foam.

In some embodiments of the present application, the above rotation support 603 may be mounted to the intermediate partition plate 5. For example, a placement space 51 with an open top is arranged at the intermediate partition plate 5, the rotation support 603 is received in the placement space 51, the fixation member 6011 has a receiving space, and when the sealing assembly 60 rotates to extend out of the receiving groove 101, an outer edge of the placement space 51 extends into the receiving space so that the sealing assembly 60 is substantially flush with the intermediate partition plate 207. Thus, the sealing assembly 60 in a state of sealing the window 2001 may be parallel or substantially parallel to the chassis 3, and a height of the sealing assembly 60 relative to the window 2001 is reduced when the sealing assembly 60 is in the state of sealing the window 2001, thereby further ensuring the sealing effect.

In the description of the present application, terms such as "first" and "second" are merely used for purpose of descriptions and cannot be understood as indicating or implying relative importance or the number of technical features indicated. Thus, the features associated with "first" and "second" may explicitly or implicitly include one or more of the features. In the description of the present application, unless otherwise specifically defined, "a plurality of" means two or more than two.

In the description of specification, terms "an embodiment," "some embodiments," "an example," "a specific example," or "some examples," means that a particular feature, structure, material, or characteristic described in connection with the embodiment or example is included in at least one embodiment or example of the present application. The schematic representation of the above terms need not refer to the same embodiment or example of the present application. Furthermore, the particular features, structures, materials, or characteristics may be combined in any suitable manner in one or more embodiments or examples. In addition, without contradiction, those skilled in the art may combine and unite different embodiments or examples or features of the different embodiments or examples described in this specification.

Although the embodiments of the present application have been shown and described, it can be understood by those skilled in the art that: various of changes, modifications, alternatives and variations can be made to these embodiments without departing from the principle and purpose of the present application, and the scope of the present application is limited by claims and their equivalents.

What is claimed is:

1. A window air conditioner comprising:

an outdoor assembly including an outdoor fan and an outdoor heat exchanger; and an indoor assembly including an indoor fan and an indoor heat exchanger, the indoor heat exchanger including:

a fin set including a plurality of fins stacked together, the fin set including:

a connection member; and a first fin member and a second fin member connected to each other via the connection member, an included angle between the first fin member and the second fin member being larger than zero, and the first fin member and the second fin member being arranged at two sides, respectively, of a notch of the fin set located at an air input side and/or an air output side of the connection member; and a refrigerant pipe set passing through the fin set;

a water receiving tray arranged below the indoor heat exchanger; and a support member arranged at the water receiving tray and supporting the indoor heat exchanger, the support member including a first support plate and a second support plate arranged at two sides of the indoor heat exchanger, respectively, the first support plate including a plastic member, and the second support plate including a sheet metal member.

2. The window air conditioner according to claim 1, further comprising:

an indoor filter screen arranged at an air input side of the indoor heat exchanger and located above the water receiving tray; and a sliding groove arranged at the support member, the indoor filter screen being inserted and fitted in the sliding groove.

3. The window air conditioner according to claim 1, further comprising:

a chassis, wherein:

the indoor assembly and the outdoor assembly are mounted at the chassis and spaced apart from each other; and a receiving groove formed by the outdoor assembly, the indoor assembly, and the chassis is configured to receive at least a part of a slidable sash of a window when the window air conditioner is supported in the window; and a sealing assembly configured to contact the sash and an inner wall of the window.

4. The window air conditioner according to claim 1, further comprising:

a chassis including a chassis body and a bracket arranged at a bottom of the chassis body and located at a side of the chassis body away from the outdoor assembly, the indoor assembly and the outdoor assembly being mounted at the chassis; and a gradienter located below the indoor assembly, the gradienter being arranged at a bottom surface of the chassis and fixed at the bracket.

5. The window air conditioner according to claim 1, wherein the notch includes two sub notches arranged at the air input side and the air output side of the connection member, respectively.

6. The window air conditioner according to claim 1, wherein a gap exists between the first fin member and the second fin member at the notch.

7. The window air conditioner according to claim 1, wherein:

the first fin member extends vertically from top to bottom;

the second fin member is connected below the first fin member via the connection member, and extends from top to bottom obliquely relative to the first fin member in a direction of the air output side; and an included angle between a first orthogonal projection of the first fin member on a plane of one of the fins and a second orthogonal projection of the second fin member on the plane is in a range of 25°-45°, and a length of the second orthogonal projection is 2~3 times of a length of the first orthogonal projection.

8. The heat exchanger window air conditioner according to claim 1, wherein:

the connection member is a first connection member and the notch is a first notch;

the fin set further includes:

a second connection member; and a third fin member connected to the second fin member via the second connection member, an included angle between the second fin member and the third fin member being larger than zero, and the second fin member and the third fin member being arranged at two sides, respectively, of a second notch of the fin set located at an air input side and/or an air output side of the second connection member; and the second fin member is located between the first notch and the second notch.

9. The window air conditioner according to claim 8, wherein the second notch includes two sub notches arranged at the air input side and the air output side of the second connection member, respectively.

10. The window air conditioner according to claim 8, wherein a gap exists between the second fin member and the third fin member at the second notch.

11. The window air conditioner according to claim 1, wherein:

the heat exchanger further includes two side plates located at two sides of the fin set, respectively;

an orthogonal projection of an extension line of one of the side plates on a plane of one of the fins coincides or is parallel to an orthogonal projection of an extension line of the fin set on the plane; and each of the side plates includes an integral member or a spliced member.

12. The window air conditioner according to claim 1, wherein:

the indoor assembly further includes:

an indoor filter screen arranged at an air input side of the indoor heat exchanger and located above the water receiving tray; and a sliding groove is arranged at the support member, and the indoor filter screen is inserted and fitted in the sliding groove.

13. The window air conditioner according to claim 12, wherein the indoor filter screen includes:

a first sub screen parallel to the first fin member or having an included angle less than or equal to 10° with the first fin member; and a second sub screen parallel to the second fin member or having an included angle less than or equal to 10° with the second fin member.

14. The window air conditioner according to claim 1, wherein:

the indoor assembly includes a volute assembly including:

a first volute; and a second volute fitted with the first volute and located at a rear side of the first volute;

the first volute and the second volute are arranged opposite to each other to form an air channel; and a plane where an air outlet of the air channel is located extends obliquely rearwards from bottom to top.

15. The window air conditioner according to claim 14, wherein an angle between the plane and a horizontal direction is larger than or equal to 135° and smaller than or equal to 155°.

16. The window air conditioner according to claim 14, wherein the volute assembly further includes a motor cage connected to the first volute and the second volute, the motor cage including:

a first cage body connected to the first volute;

a second cage body connected to the second volute; and at least one of a snap or a screw connecting the first cage body and the second cage body.

17. The window air conditioner according to claim 14, wherein the volute assembly further includes:

a bearing cover including:

a first cover body connected to the first volute;

a second cover body connected to the second volute; and at least one of a snap or a screw connecting the first cover body and the second cover body;

an air guide plate rotatably arranged at the air outlet; and a drive motor configured to drive the air guide plate to rotate.

18. The window air conditioner according to claim 14, wherein the volute assembly further includes a decorative strip located in the air outlet, an inner end of the decorative strip being connected to an end face of the air outlet, and along an air output direction, an outer end of the decorative strip extends obliquely in a direction running away from a center of the air outlet.

* * * * *